US011776438B2

(12) United States Patent
Song

(10) Patent No.: US 11,776,438 B2
(45) Date of Patent: Oct. 3, 2023

(54) DETECTING METHOD OF PIXEL CIRCUIT, DRIVING METHOD OF DISPLAY PANEL AND DISPLAY DEVICE

(71) Applicant: BOE TECHNOLOGY GROUP CO., LTD., Beijing (CN)

(72) Inventor: Danna Song, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 1153 days.

(21) Appl. No.: 16/467,022

(22) PCT Filed: Oct. 31, 2018

(86) PCT No.: PCT/CN2018/112954
§ 371 (c)(1),
(2) Date: Jun. 7, 2019

(87) PCT Pub. No.: WO2019/144669
PCT Pub. Date: Aug. 1, 2019

(65) Prior Publication Data

US 2023/0206792 A1 Jun. 29, 2023

(30) Foreign Application Priority Data

Jan. 29, 2018 (CN) ..... 201810085782.1

(51) Int. Cl.
*G09G 3/3233* (2016.01)
*G09G 3/00* (2006.01)

(52) U.S. Cl.
CPC ..... *G09G 3/006* (2013.01); *G09G 3/3233* (2013.01); *G09G 2300/0842* (2013.01);
(Continued)

(58) Field of Classification Search
CPC ..... G09G 3/3233; G09G 2320/0233; G09G 2320/045; G09G 2320/0295; G09G 2360/16; G09G 2320/043; G09G 2320/029
See application file for complete search history.

(56) References Cited

U.S. PATENT DOCUMENTS 10,650,744 B2 5/2020 Jin et al.
10,896,643 B2 1/2021 Li et al.
(Continued)

FOREIGN PATENT DOCUMENTS

CN 106847187 A 12/2010
CN 107093403 A 6/2017
EP 3699898 A1 8/2020

OTHER PUBLICATIONS

Search report issued in European application serial No. 18882298.5 and dated Sep. 14, 2021, 9 pages.

*Primary Examiner* — Dennis P Joseph
(74) *Attorney, Agent, or Firm* — Dave Law Group LLC; Raj S. Dave

(57) ABSTRACT

A detecting method of a pixel circuit, a driving method of a display panel and a display device are provided. The pixel circuit includes a driving transistor, and the detecting method comprises: in a first charging cycle, applying a first data voltage to a gate electrode of the driving transistor, and in a first time duration, obtaining a first sensing voltage at a first electrode of the driving transistor and determining whether the first sensing voltage is equal to a first reference sensing voltage; and in a second charging cycle, applying a second data voltage to the gate electrode of the driving transistor, and in a second time duration, obtaining a second sensing voltage at the first electrode of the driving transistor and determining whether the second sensing voltage is equal to a second reference sensing voltage.

20 Claims, 10 Drawing Sheets

(52) U.S. Cl.
CPC ..... *G09G 2320/0233* (2013.01); *G09G 2320/0295* (2013.01); *G09G 2320/045* (2013.01); *G09G 2360/16* (2013.01)

(56) References Cited

U.S. PATENT DOCUMENTS

| | | | | |
|---|---|---|---|---|
| 2017/0004764 | A1* | 1/2017 | Kim | G09G 3/3233 |
| 2017/0053590 | A1* | 2/2017 | Song | G09G 3/3233 |
| 2019/0172394 | A1* | 6/2019 | Wang | G09G 3/3258 |
| 2021/0201789 | A1* | 7/2021 | Meng | G09G 3/3233 |

* cited by examiner

DETECTING METHOD OF PIXEL CIRCUIT, DRIVING METHOD OF DISPLAY PANEL AND DISPLAY DEVICE

CROSS-REFERENCE TO RELATED APPLICATIONS

The present application is the U.S. national stage of International Patent Application No. PCT/CN2018/112954, filed Oct. 31, 2018, which claims the benefit of priority of Chinese patent application No. 201810085782.1, filed on Jan. 29, 2018, and the entire content disclosed by the PCT and Chinese patent applications are incorporated herein by reference as part of the present application.

TECHNICAL FIELD

Embodiments of the present disclosure relate to a detecting method of a pixel circuit, a driving method of a display panel and a display device.

BACKGROUND

Organic light emitting diode (OLED) display panel has received increasing attention due to their wide viewing angle, high contrast ratio, fast response speed, higher light-emitting brightness and lower driving voltage than inorganic light-emitting display devices. Wide attention. Due to the above characteristics, the organic light emitting diode (OLED) display panel can be applied to a device having a display function such as a mobile phone, a display, a notebook computer, a digital camera, an instrument meter, and the like.

SUMMARY

At least one embodiment of the present disclosure provides a detecting method of a pixel circuit, the pixel circuit comprises a driving transistor, and the detecting method comprises: in a first charging cycle, applying a first data voltage to a gate electrode of the driving transistor, and in a first time duration after applying the first data voltage and before the driving transistor is turned off, obtaining a first sensing voltage at a first electrode of the driving transistor and determining whether the first sensing voltage is equal to a first reference sensing voltage; and in a second charging cycle, applying a second data voltage to the gate electrode of the driving transistor, and in a second time duration after applying the second data voltage and before the driving transistor is turned off, obtaining a second sensing voltage at the first electrode of the driving transistor and determining whether the second sensing voltage is equal to a second reference sensing voltage. If the first sensing voltage is equal to the first reference sensing voltage and the second sensing voltage is equal to the second reference sensing voltage, obtaining a present current coefficient of the driving transistor according to the first data voltage, the second data voltage and a first formula: $K=(Vd1-Vd2)/(L1^{1/2}-L2^{1/2})$; and obtaining a present threshold voltage of the driving transistor according to a second formula: $Vth=(Vd2*L1^{1/2}-Vd1*L2^{1/2})/(L1^{1/2}-L2^{1/2})$, where K represents the present current coefficient of the driving transistor, Vth represents the present threshold voltage of the driving transistor, Vd1 represents the first data voltage, Vd2 represents the second data voltage, L1 represents a first luminance value, L2 represents a second luminance value, and the first luminance value and the second luminance value are both specified normalized luminance values.

For example, a detecting method provided by an embodiment of the present disclosure further comprises: in a first reference charging cycle, applying a first reference data voltage to the gate electrode of the driving transistor, and in the first time duration after applying the first reference data voltage, obtaining the first reference sensing voltage at the first electrode of the driving transistor; and in a second reference charging cycle, applying a second reference data voltage to the gate electrode of the driving transistor, and in the second time duration after applying the second reference data voltage, obtaining the second reference sensing voltage at the first electrode of the driving transistor; obtaining the first reference data voltage according a third formula: $Vdr1=Kr*L1^{1/2}+Vthr$, and obtaining the second reference data voltage according a fourth formula: $Vdr2=Kr*L2^{1/2}+Vthr$, where Vdr1 represents the first reference data voltage, Vdr2 represents the second reference data voltage, Kr represents a reference current coefficient of the driving transistor, and Vthr represents a reference threshold voltage of the driving transistor.

For example, a detecting method provided by an embodiment of the present disclosure further comprises: in a case where the first sensing voltage is not equal to the first reference sensing voltage, in a third charging cycle, applying a third data voltage to the gate electrode of the driving transistor, and in the first time duration after applying the third data voltage, obtaining a third sensing voltage at the first electrode of the driving transistor; and selecting the third data voltage such that a difference between the third sensing voltage and the first reference sensing voltage is less than a difference between the first sensing voltage and the first reference sensing voltage.

For example, a detecting method provided by an embodiment of the present disclosure further comprises: in a case where the second sensing voltage is not equal to the second reference sensing voltage, in a fourth charging cycle, applying a fourth data voltage to the gate electrode of the driving transistor, and in the second time duration after applying the fourth data voltage, obtaining a fourth sensing voltage at the first electrode of the driving transistor; and selecting the fourth data voltage such that a difference between the fourth sensing voltage and the second reference sensing voltage is less than a difference between the second sensing voltage and the first reference sensing voltage.

For example, in a detecting method provided by an embodiment of the present disclosure, in a case where the first sensing voltage is less than the first reference sensing voltage, causing the third data voltage to be greater than the first data voltage; and in a case where the first sensing voltage is greater than the first reference sensing voltage, causing the third data voltage to be less than the first data voltage.

For example, in a detecting method provided by an embodiment of the present disclosure, in a case where the second sensing voltage is less than the second reference sensing voltage, causing the fourth data voltage to be greater than the second data voltage; and in a case where the second sensing voltage is greater than the second reference sensing voltage, causing the fourth data voltage to be less than the second data voltage.

For example, a detecting method provided by an embodiment of the present disclosure further comprises: in a case where the third sensing voltage is still not equal to the first reference sensing voltage, repeating the third charging cycle until the third sensing voltage is equal to the first reference sensing voltage; in a case where the fourth sensing voltage is still not equal to the second reference sensing voltage, repeating the fourth charging cycle until the fourth sensing voltage is equal to the second reference sensing voltage; and obtaining a present current coefficient of the driving transistor according to the third data voltage, the fourth data voltage and a fifth formula: $K=(Vd3-Vd4)/(L1^{1/2}-L2^{1/2})$; and obtaining a present threshold voltage of the driving transistor according to a sixth formula: $Vth=(Vd4*L1^{1/2}-Vd3*L2^{1/2})/(L1^{1/2}-L2^{1/2})$, where Vd3 represents the third data voltage, and Vd4 represents the fourth data voltage.

For example, a detecting method provided by an embodiment of the present disclosure further comprises: obtaining the reference threshold voltage and the reference current coefficient. Obtaining the reference threshold voltage comprises: in a power-off charging cycle when the pixel circuit is in a power-off state, applying a power-off data voltage to the gate electrode of the driving transistor, and after the driving transistor is turned off, obtaining a power-off sensing voltage at the first electrode of the driving transistor; wherein the reference threshold voltage of the driving transistor is equal to a difference between the power-off data voltage and the power-off sensing voltage. Obtaining the reference current coefficient comprises: causing a normalized luminance value of the pixel circuit to reach a maximum value of 1, obtaining a data voltage Vmax applied to the gate electrode of the driving transistor at this time, and then obtaining the reference current coefficient according to a seventh formula: $Vmax=Kr+Vthr$.

For example, in a detecting method provided by an embodiment of the present disclosure, the power-off charging cycle is the same as the first reference charging cycle, and the power-off data voltage is equal to the first reference data voltage; or the power-off charging cycle is the same as the second reference charging cycle, and the power-off data voltage is equal to the second reference data voltage.

For example, in a detecting method provided by an embodiment of the present disclosure, the first charging cycle, the second charging cycle, the third charging cycle, and the fourth charging cycle are between display cycles.

For example, in a detecting method provided by an embodiment of the present disclosure, the first time duration is the same as the second time duration.

At least one embodiment of the present disclosure provides a driving method of a display panel, the display panel comprises a pixel circuit, and the driving method comprises: performing the detecting method of a pixel circuit according to any one of the embodiments of the present disclosure, so as to obtain a present threshold voltage of a driving transistor of the pixel circuit and a present current coefficient of the driving transistor of the pixel circuit.

For example, a driving method provided by an embodiment of the present disclosure further comprises: establishing a compensation data voltage of the pixel circuit according to the present threshold voltage, the present current coefficient and an eighth formula: $Vc=K*L^{1/2}+Vth$, where Vc represents the compensation data voltage, K represents the present current coefficient, Vth represents the present threshold voltage, and L represents a normalized luminance value to be displayed by the pixel circuit.

At least one embodiment of the present disclosure provides a display device, comprising a pixel circuit and a control circuit, the pixel circuit comprises a driving transistor, and the control circuit is configured to perform the detecting method according to any one of the embodiments of the present disclosure.

For example, in a display device provided by an embodiment of the present disclosure, the control circuit is further configured to perform: in a first reference charging cycle, applying a first reference data voltage to the gate electrode of the driving transistor, and in the first time duration after applying the first reference data voltage, obtaining the first reference sensing voltage at the first electrode of the driving transistor; in a second reference charging cycle, applying a second reference data voltage to the gate electrode of the driving transistor, and in the second time duration after applying the second reference data voltage, obtaining the second reference sensing voltage at the first electrode of the driving transistor; obtaining the first reference data voltage according a third formula: $Vdr1=Kr*L1^{1/2}+Vthr$, and obtaining the second reference data voltage according a fourth formula: $Vdr2=Kr*L2^{1/2}+Vthr$; where Vdr1 represents the first reference data voltage, Vdr2 represents the second reference data voltage, Kr represents a reference current coefficient of the driving transistor, and Vthr represents a reference threshold voltage of the driving transistor.

For example, a display device provided by an embodiment of the present disclosure further comprises a data driving circuit and a detecting circuit. The data driving circuit is configured to output the first reference data voltage, the second reference data voltage, the first data voltage and the second data voltage. The pixel circuit is further configured to receive the first reference data voltage, the second reference data voltage, the first data voltage and the second data voltage, and apply one of the first reference data voltage, the second reference data voltage, the first data voltage and the second data voltage to the gate electrode of the driving transistor. The detecting circuit is configured to read the first reference sensing voltage, the second reference sensing voltage, the first sensing voltage and the second sensing voltage from the first electrode of the driving transistor. The control circuit is further configured to control the data driving circuit and the detecting circuit.

For example, in a display device provided by an embodiment of the present disclosure, the pixel circuit further comprises a light emitting element and a sensing switch transistor. A second electrode and the first electrode of the driving transistor are configured to be respectively connected with a first power voltage terminal and a first electrode of the light emitting element. A second electrode of the light emitting element is connected with a second power voltage terminal. A first electrode of the sensing switch transistor is electrically connected with the first electrode of the driving transistor, and a second electrode of the sensing switch transistor is electrically connected with the detecting circuit.

For example, in a display device provided by an embodiment of the present disclosure, the pixel circuit further comprises a sensing line, and the sensing line electrically connects the second electrode of the sensing switch transistor with the detecting circuit.

For example, in a display device provided by an embodiment of the present disclosure, the pixel circuit further comprises a data writing transistor and a storage capacitor. The data writing transistor is configured to obtain a data voltage from the data driving circuit and write the data voltage to the gate electrode of the driving transistor, and the storage capacitor is configured to store the data voltage.

For example, in a display device provided by an embodiment of the present disclosure, the control circuit comprises a processor and a storage medium. The storage medium is configured to store computer instructions executable by the processor, and the computer instructions are capable of being executed by the processor to implement the detecting method.

BRIEF DESCRIPTION OF THE DRAWINGS

In order to demonstrate clearly technical solutions of the embodiments of the present disclosure, the accompanying drawings in relevant embodiments of the present disclosure will be introduced briefly. It is apparent that the drawings may only relate to some embodiments of the disclosure and not intended to limit the present disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. It is apparent that the described embodiments are just a part but not all of the embodiments of the disclosure. Based on the described embodiments herein, those skilled in the art can obtain other embodiment, without any creative work, which shall be within the scope of the disclosure.

Unless otherwise defined, all the technical and scientific terms used herein have the same meanings as commonly understood by one of ordinary skill in the art to which the present disclosure belongs. The terms, such as "first," "second," or the like, which are used in the description and the claims of the present disclosure, are not intended to indicate any sequence, amount or importance, but for distinguishing various components. The terms, such as "comprise/comprising," "include/including," or the like are intended to specify that the elements or the objects stated before these terms encompass the elements or the objects and equivalents thereof listed after these terms, but not preclude other elements or objects. The terms, such as "connect/connecting/connected," "couple/coupling/coupled" or the like, are not limited to a physical connection or mechanical connection, but may include an electrical connection/coupling, directly or indirectly. The terms, "on," "under," "left," "right," or the like are only used to indicate relative position relationship, and when the position of the object which is described is changed, the relative position relationship may be changed accordingly.

A pixel circuit in an OLED display device generally adopts a matrix driving method, and the matrix driving is divided into an active matrix driving and a passive matrix driving according to whether or not a switching component is introduced in each pixel unit. AMOLED (Active Matrix OLED) integrates a set of thin film transistor and storage capacitor in the pixel circuit of each pixel unit. Control of the current flowing through the OLED is achieved by driving control of the thin film transistor and the storage capacitor, thereby causing the OLED to emit light as needed.

Figure 1A:
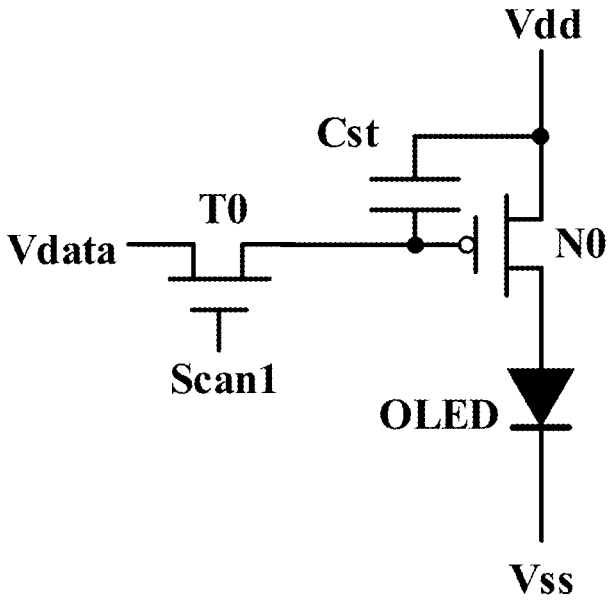
FIG. 1A is a schematic diagram of a pixel circuit.
Figure 1B:
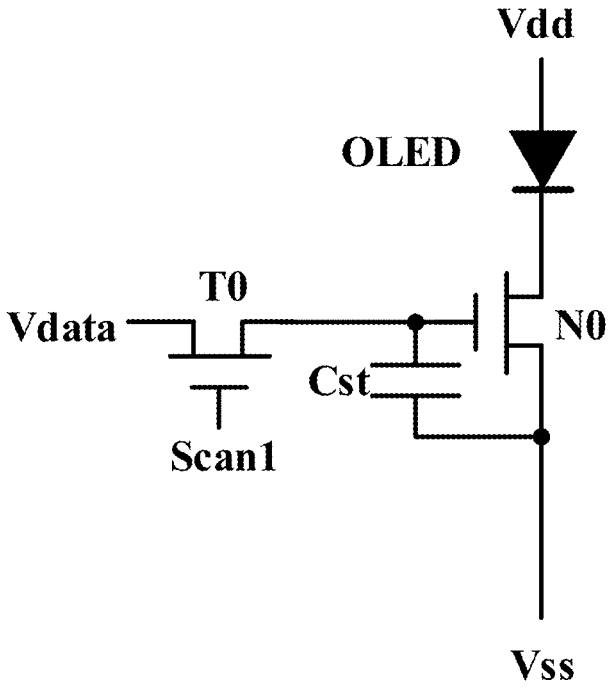
FIG. 1B is a schematic diagram of another pixel circuit.

The basic pixel circuit used in the AMOLED display device is usually a 2T1C pixel circuit, which means it has a function of driving the OLED to emit light by using two thin film transistors and one storage capacitor Cst. FIG. 1A and FIG. 1B show schematic diagrams of two 2T1C pixel circuits, respectively.

As shown in FIG. 1A, a 2T1C pixel circuit includes a switching transistor TO, a driving transistor N0 and a storage capacitor Cst. For example, a gate electrode of the switching transistor T0 is connected with a scanning line to receive a scanning signal Scan1. For example, a source electrode of the switching transistor T0 is connected with a data line to receive a data signal Vdata. A drain electrode of the switching transistor T0 is connected with a gate electrode of the driving transistor N0. A source electrode of the driving transistor N0 is connected with a first voltage terminal for receiving a first voltage Vdd (high voltage), a drain electrode of the driving transistor N0 is connected with a positive terminal of the OLED. One terminal of the storage capacitor Cst is connected with the drain electrode of the switching transistor T0 and the gate electrode of the driving transistor N0, and the other one terminal of the storage capacitor Cst is connected with the source electrode of the driving transistor N0 and the first voltage terminal. A negative terminal of the OLED is connected with a second voltage terminal to receive a second voltage Vss (low voltage, such as a ground voltage). The driving mode of the 2T1C pixel circuit is to control the brightness and darkness (gray scale) of the pixel through the two TFTs and the storage capacitor Cst. When the scan signal Scan1 is applied through the scanning line to turn on the switching transistor T0, the data signal Vdata input by the data driving circuit through the data line can charge the storage capacitor Cst through the switching transistor T0, thereby the data signal Vdata can be stored in the storage capacitor Cst, and the stored data signal Vdata can control the degree of conduction of the driving transistor N0, thereby controlling the magnitude of the current flowing through the driving transistor N0 to drive the OLED to emit light, that is, the current determines the gray scale of the pixel. In the 2T1C pixel circuit as shown in FIG. 1A, the switching transistor T0 is an N-type transistor and the driving transistor N0 is a P-type transistor.

As shown in FIG. 1B, another 2T1C pixel circuit also includes the switching transistor T0, the driving transistor N0 and the storage capacitor Cst, but the connection mode thereof is changed, and the driving transistor N0 is an N-type transistor. The difference of the pixel circuit as shown in FIG. 1B with respect to FIG. 1A includes: the positive terminal of the OLED is connected with the first voltage terminal to receive the first voltage Vdd (high voltage), and the negative terminal of the OLED is connected with the drain electrode of the driving transistor N0, and the source electrode of the driving transistor N0 is connected with the second voltage terminal to receive the second voltage Vss (low voltage, such as the ground voltage). One terminal of the storage capacitor Cst is connected with the drain electrode of the switching transistor T0 and the gate electrode of the driving transistor N0, and the other terminal is connected with the source electrode of the driving transistor N0 and the second voltage terminal. The operation mode of the 2T1C pixel circuit is basically the same as that of the pixel circuit as shown in FIG. 1A, and details are not described herein again.

In addition, with respect to the pixel circuits as shown in FIGS. 1A and 1B, the switching transistor T0 is not limited to an N-type transistor, and can be a P-type transistor, and it is only necessary to control the scanning signal Scan1 to change accordingly.

An OLED display device typically includes a plurality of pixel units arranged in an array, each of the plurality of pixel units can include, for example, the above-described pixel circuit. When the pixel circuit performs display, an output current $I_{OLED}$ of the driving transistor N0 of the pixel circuit in a saturated state can be obtained by the following formula:

$$I_{OLED}=\frac{1}{2}*K(Vg-Vs-Vth)^2;$$

Where K=W/L*C*μ, W/L is a width to length ratio of a channel of the driving transistor N0 (i.e., the ratio of the width to the length), μ is the electron mobility, C is a capacitance per unit area, Vg is the voltage of the gate electrode of the driving transistor N0, Vs is the voltage of the source electrode of the driving transistor N0, and Vth is the threshold voltage of the driving transistor N0. It should be noted that in the embodiments of the present disclosure, K is referred to as a current coefficient of a driving transistor of a pixel circuit, and the following embodiments are the same as those described herein, and are not described again.

The threshold voltages Vth of driving transistors in different pixel circuits may be different due to the fabrication process, and the threshold voltage Vth of the driving transistor may cause a drift phenomenon due to, for example, a change in temperature. In addition, the current coefficient K of the driving transistor also ages over time. Therefore, the difference between the threshold voltage Vth and the current coefficient K of each of the driving transistors and aging and may cause display defects (e.g., display unevenness), so it is necessary to compensate the threshold voltage Vth and current coefficient K.

For example, after a data signal (e.g., data voltage) Vdata is applied to the gate electrode of the driving transistor N0 through the switching transistor T0, the data signal Vdata can charge the storage capacitor Cst, and because the data signal Vdata can cause the driving transistor N0 to be turned on, a voltage Vs of the source electrode (or the drain electrode) of the driving transistor N0 which is electrically connected with one terminal of the storage capacitor Cst may be correspondingly changed.

Figure 1C:
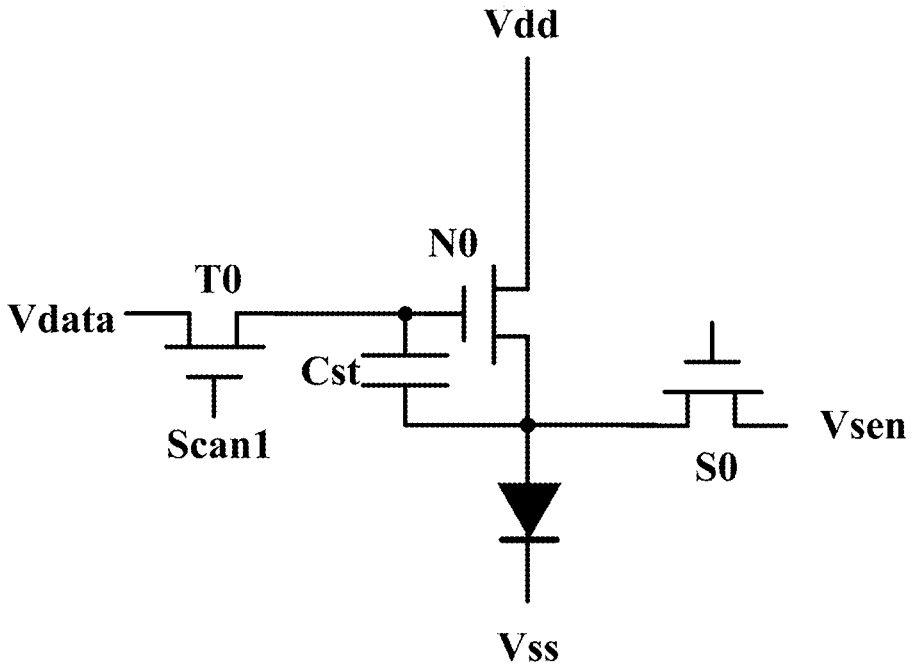
FIG. 1C is a schematic diagram of another pixel circuit.

For example, FIG. 1C shows a pixel circuit (that is, a 3T1C circuit) that can detect the threshold voltage of the driving transistor, and the driving transistor N0 is an N-type transistor. For example, as shown in FIG. 1C, in order to implement a compensation function, a sensing transistor S0 can be introduced on the basis of the 2T1C circuit. A first terminal of the sensing transistor S0 is connected with the source electrode of the driving transistor N0, and a second terminal of the sensing transistor S0 is connected with a detecting circuit (not shown in FIG. 1C) through a sensing line. Therefore, when the driving transistor N0 is turned on, the detecting circuit can be charged through the sensing transistor S0, so that the voltage of the source electrode of the driving transistor N0 changes. When the voltage Vs of the source electrode of the driving transistor N0 is equal to the difference between the voltage Vg of the gate electrode of the driving transistor N0 and the threshold voltage Vth of the driving N0, the driving transistor N0 is turned off. At this time, after the driving transistor N0 is turned off, a sensing voltage (i.e., the voltage Vb of the source electrode of the driving transistor N0 after the driving transistor N0 is turned off) can be obtained from the source electrode of the driving transistor N0 through the turned-on sensing transistor S0. After obtaining the voltage Vb of the source electrode of the driving transistor N0 after the driving transistor N0 is turned off, the threshold voltage Vth=Vdata−Vb of the driving transistor can be obtained, thereby compensation data can be established for each pixel circuit based on the threshold voltage of the driving transistor in each pixel circuit, and enabling compensation of the threshold voltage of each sub-pixel in a display panel.

Figure 1D:
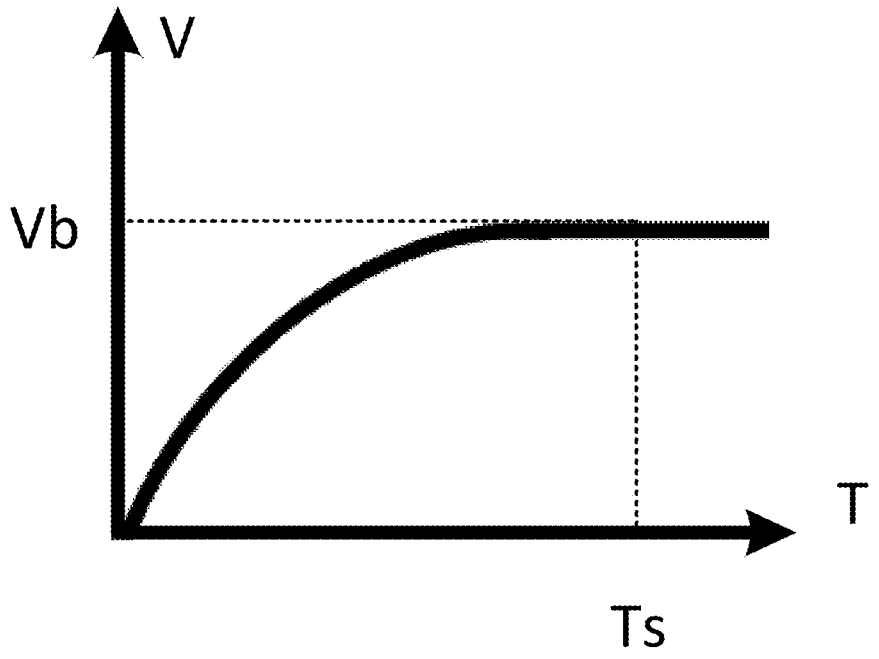
FIG. 1D is a curve of a sensing voltage versus time.

FIG. 1D shows a curve of a sensing voltage versus time, which is taken from the source electrode of the driving transistor N0 through the turned-on sensing transistor S0. The inventors noted that, after applying the data signal Vdata, in the process of charging the detecting circuit through the sensing line, as a charging time for the storage capacitor Cst or the like increases, a charging speed is correspondingly lowered (that is, a speed at which the sensing voltage increases is lowered) (see FIG. 1D), because a charging current will decrease as the sensing voltage (that is, the voltage Vs of the source electrode of the driving transistor N0) increases. Specifically, the output current $I_{OLED}$ of the driving transistor N0 in the saturated state can be obtained by the following formula:

$$I_{OLED} = 1/2 * K(Vg - Vs - Vth)^2$$
$$= 1/2 * K(Vdata - Vs - Vth)^2$$
$$= 1/2 * K((Vdata - Vth) - Vs)^2.$$

Where $K = W/L * C * \mu$,

W/L is the width to length ratio of the channel of the driving transistor N0 (that is, the ratio of the width to the length), μ is the electron mobility, and C is the capacitance per unit area.

In the process in which the voltage Vs of the source electrode of the driving transistor N0 is increased to Vdata–Vth, as Vs increases, a value of [(Vdata–Vth)-Vs] is continuously lowered, correspondingly, the current $I_{OLED}$ output by the driving transistor N0 and the charging speed will also be continuously reduced. Therefore, the time Ts required from the start of charging to the turn-off of the driving transistor N0 is long, so it is usually required to perform detection during a power-off process after the display panel ends normal display, and the threshold voltage of the driving transistor N0 cannot be detected during a power-on period (for example, between adjacent display periods in a display process), and real-time detection and compensation cannot be realized, which will reduce the compensation effect and brightness uniformity of the display panel.

At least one embodiment of the present disclosure provides a detecting method of a pixel circuit, the detecting method can realize the detection of the threshold voltage and the current coefficient of the pixel circuit during the power-on period, thereby improving the compensation effect and the brightness uniformity. At least one embodiment of the present disclosure further provides a driving method of a display panel and a display device corresponding to the above-mentioned detecting method.

Embodiments of the present disclosure are described in detail below with reference to the accompanying drawings.

At least one embodiment of the present disclosure provides a detecting method of a pixel circuit, and the detecting method of the pixel circuit can be used to detect a present threshold voltage Vth and a present current coefficient K of a driving transistor of the pixel circuit. For example, the detecting method of the pixel circuit provided in this embodiment will be specifically described below with reference to FIG. 2A to FIG. 2C.

Figure 6A:
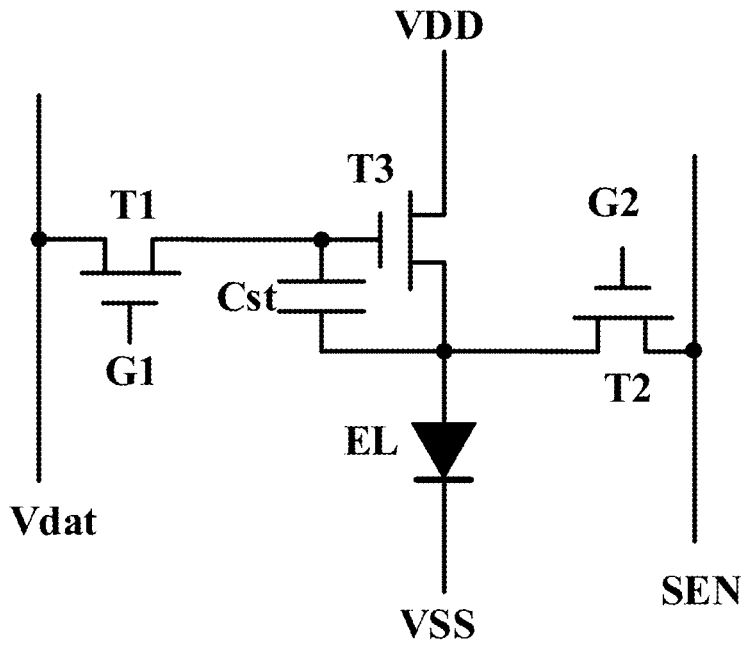
FIG. 6A is a schematic diagram of a pixel circuit provided by an embodiment of the present disclosure.
Figure 6B:
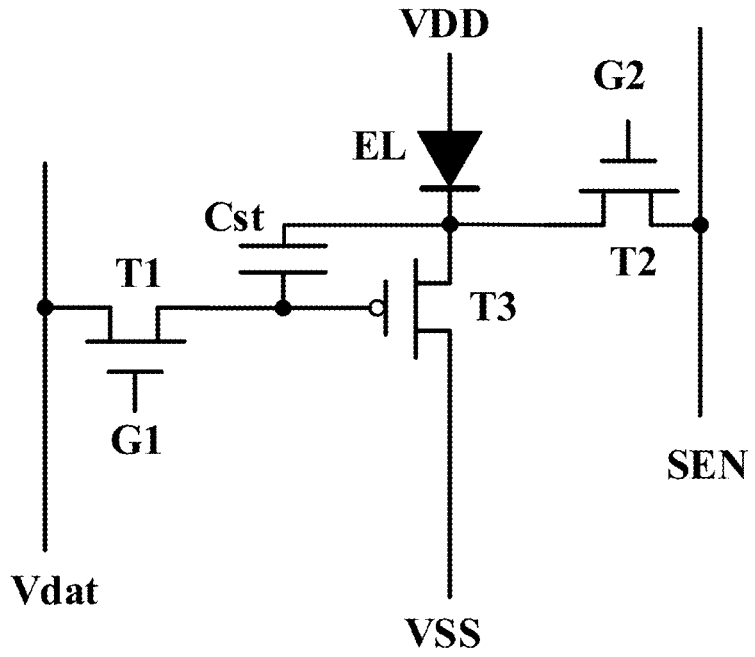
FIG. 6B is a schematic diagram of another pixel circuit provided by an embodiment of the present disclosure.

For example, the pixel circuit may include a driving transistor (for example, the driving transistor T3 as shown in FIG. 6A or 6B). For example, a gate voltage applied to the driving transistor is denoted as DATA. For example, the detecting method of the pixel circuit may include the following operations:

Step S110: in a first charging cycle, applying a first data voltage Vd1 to a gate electrode of the driving transistor, and in a first time duration after applying the first data voltage Vd1 and before the driving transistor is turned off, obtaining a first sensing voltage Vs1 at a first electrode of the driving transistor and determining whether the first sensing voltage Vs1 is equal to a first reference sensing voltage Vsr1;

Step S120: in a second charging cycle, applying a second data voltage Vd2 to the gate electrode of the driving transistor, and in a second time duration after applying the second data voltage Vd2 and before the driving transistor is turned off, obtaining a second sensing voltage Vs2 at the first electrode of the driving transistor and determining whether the second sensing voltage Vs2 is equal to a second reference sensing voltage Vsr2; and Step S130: if the first sensing voltage Vs1 is equal to the first reference sensing voltage Vsr1 and the second sensing voltage Vs2 is equal to the second reference sensing voltage Vsr2, obtaining a present current coefficient of the driving transistor according to the first data voltage Vd1, the second data voltage Vd2 and a first formula: $K=(Vd1-Vd2)/(L1^{1/2}-L2^{1/2})$; and obtaining a present threshold voltage Vth of the driving transistor according to a second formula: $Vth=(Vd2*L1^{1/2}-Vd1*L2^{1/2})/(L1^{1/2}-L2^{1/2})$.

In the above formulas, K represents the present current coefficient of the driving transistor, Vth represents the present threshold voltage of the driving transistor, Vd1 represents the first data voltage, Vd2 represents the second data voltage, L1 represents a first luminance value, L2 represents a second luminance value, and the first luminance value and the second luminance value are both specified normalized luminance values.

Figure 2A:
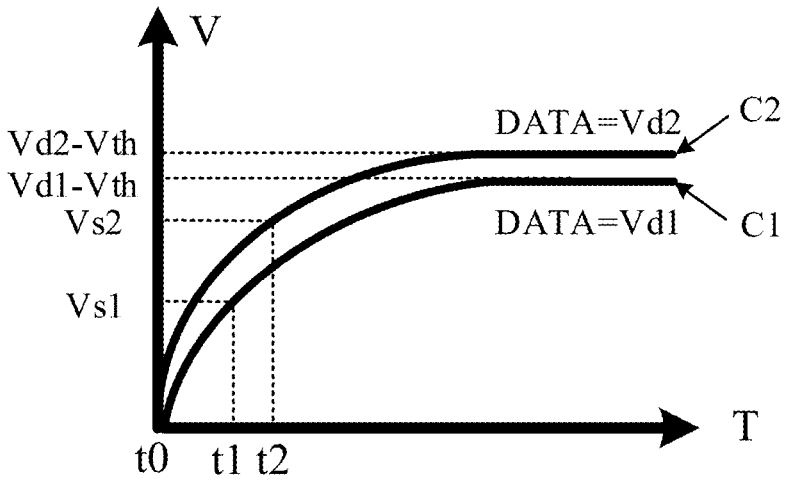
FIG. 2A shows sensing voltages versus time curves respectively in a first charging cycle and a second charging cycle, in a detecting method of a pixel circuit according to an embodiment of the present disclosure.

For example, FIG. 2A shows a voltage (that is, a sensing voltage) versus time curve C1 of the first electrode of the driving transistor in the first charging cycle and a voltage (that is, a sensing voltage) versus time curve C2 of the first electrode of the driving transistor in the second charging cycle.

As shown in FIG. 2A, in step S110, for example, the first data voltage Vd1 is applied to the gate electrode of the driving transistor at a start time t0 of the first charging cycle, and then in the first time duration (that is, t1–t0) after applying the first data voltage Vd1, the first sensing voltage Vs1 is obtained at the first electrode of the driving transistor, and it is determined whether the first sensing voltage Vs1 is equal to the first reference sensing voltage Vsr1.

As shown in FIG. 2A, in step S120, for example, the second data voltage Vd2 is applied to the gate electrode of the driving transistor at a start time t0 of the second charging cycle, and then in the second time duration (that is, t2–t0) after applying the second data voltage Vd2, the second sensing voltage Vs2 is obtained at the first electrode of the driving transistor, and it is determined whether the second sensing voltage Vs2 is equal to the second reference sensing voltage Vsr2.

In step S130, if it is determined in step S110 that the first sensing voltage Vs1 is equal to the first reference sensing voltage Vsr1, and it is determined in step S120 that the second sensing voltage Vs2 is equal to the second reference sensing voltage Vsr2, then the present current coefficient K of the driving transistor is obtained according to the first data voltage Vd1, the second data voltage Vd2 and the first formula: $K=(Vd1-Vd2)/(L1^{1/2}-L2^{1/2})$; and the present threshold voltage Vth of the driving transistor according to the second formula: $Vth=(Vd2*L1^{1/2}-Vd1*L2^{1/2})/(L1^{1/2}-L2^{1/2})$.

It should be noted that, in FIG. 2A, the second data voltage Vd2 is greater than the first data voltage Vd1, and the embodiments of the present disclosure include but are not limited thereto, for example, the second data voltage Vd2 may be smaller than the first data voltage Vd1.

In addition, it should be noted that, in the embodiments of the present disclosure, the first luminance value L1 and the second luminance value L2 are both specified (that is, pre-set) normalized luminance values. For example, the maximum luminance value corresponding to the maximum data voltage is normalized to 1.

For example, in the first formula and the second formula, the first luminance value L1=¼ and the second luminance value L2=1 may be made. The embodiments of the present disclosure do not limit the values of L1 and L2, for example, L1=⅙, L2=¼; or L1=⅙, L2=1, and the like. In addition, in a case where the first data voltage Vd1 is greater than the second data voltage Vd2, it is also possible to make L1=1, L2=¼; or L1=¼, L2=⅙; or L1=1. L2=⅙ and so on.

Figure 2B:
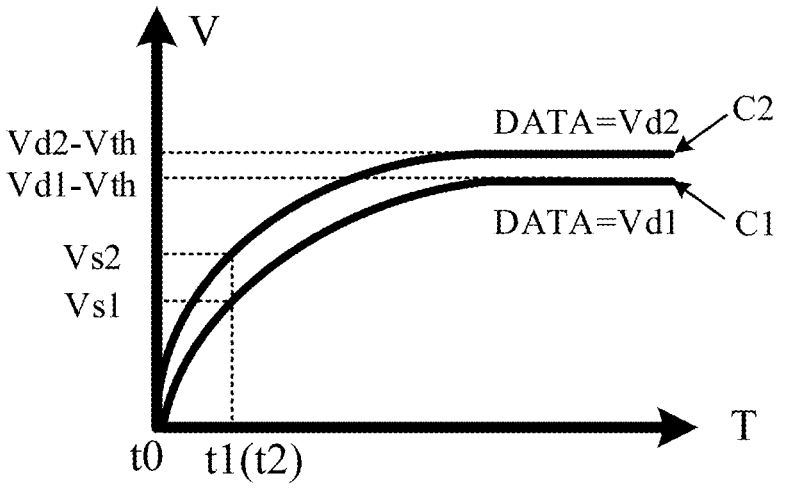
FIG. 2B shows sensing voltages versus time curves respectively in a first charging cycle and a second charging cycle, in a case where a first time duration is the same as a second time duration, in a detecting method of a pixel circuit according to an embodiment of the present disclosure.

In addition, it should be noted that, in the embodiments of the present disclosure, the first time duration (t1−t0) and the second time duration (t2−t0) may be set to be different, for example, as shown in FIG. 2A, the embodiments of the present disclosure including but not limited to this, for example, as shown in FIG. 2B, the first time duration (t1−t0) and the second time duration (t2−t0) may also be set to be the same.

For example, applying the first data voltage Vd1 or the second data voltage Vd2 to the gate electrode of the driving transistor means that a data voltage supplied through a data line of the pixel circuit (for example, the data line Vdat as shown in FIG. 6A or FIG. 6B) is the first data voltage Vd1 or the second data voltage Vd2. Here, the first electrode of the driving transistor refers to an electrode electrically connected with the sensing switch transistor T2, which may be a source electrode or a drain electrode according to a specific pixel circuit design.

In the embodiments of the present disclosure, the first sensing voltage Vs1 is obtained in the first charging cycle and it is determined whether the first sensing voltage Vs1 is equal to the first reference sensing voltage Vsr1; and the second sensing voltage Vs2 is obtained in the second charging cycle and it is determined whether the second sensing voltage Vs2 is equal to the second reference sensing voltage Vsr2. If the first sensing voltage Vs1 is equal to the first reference sensing voltage Vsr1, and the second sensing voltage Vs2 is equal to the second reference sensing voltage Vsr2, the present current coefficient K of the driving transistor can be obtained according to the first formula and the present threshold voltage Vth of the driving transistor can be obtained according to the second formula, thereby completing the compensation detection of the pixel circuit, and improving the compensation effect and brightness uniformity of the display panel using the detecting method of the pixel circuit. In the detecting method of the pixel circuit provided by the embodiment of the present disclosure, in the first charging cycle and the second charging cycle, the sensing voltages (the first sensing voltage Vs1 and the second sensing voltage Vs2) are obtained at the first electrode of the driving transistor before the driving transistor is turned off, thereby the detection time can be shortened, and the detection efficiency can be improved.

In the embodiments of the present disclosure, for example, the first sensing voltage Vs1 being equal to the first reference sensing voltage Vsr1 may mean that the first sensing voltage Vs1 is completely equal to the first reference sensing voltage Vsr1, thereby making the compensation data established for each pixel circuit more accurate. For another example, the first sensing voltage Vs1 being equal to the first reference sense Vsr1 may also mean that the difference between the first sensing voltage Vs1 and the first reference sensing voltage Vsr1 is less than a certain value (For example, less than 1% of the average value of the first sensing voltage Vs1 and the first reference sensing voltage Vsr1), thereby the detection time of the pixel circuit can be shortened. The description about the second sensing voltage Vs2 and the second reference sensing voltage Vsr2 is the same as that, and will not be described again.

Figure 2C:
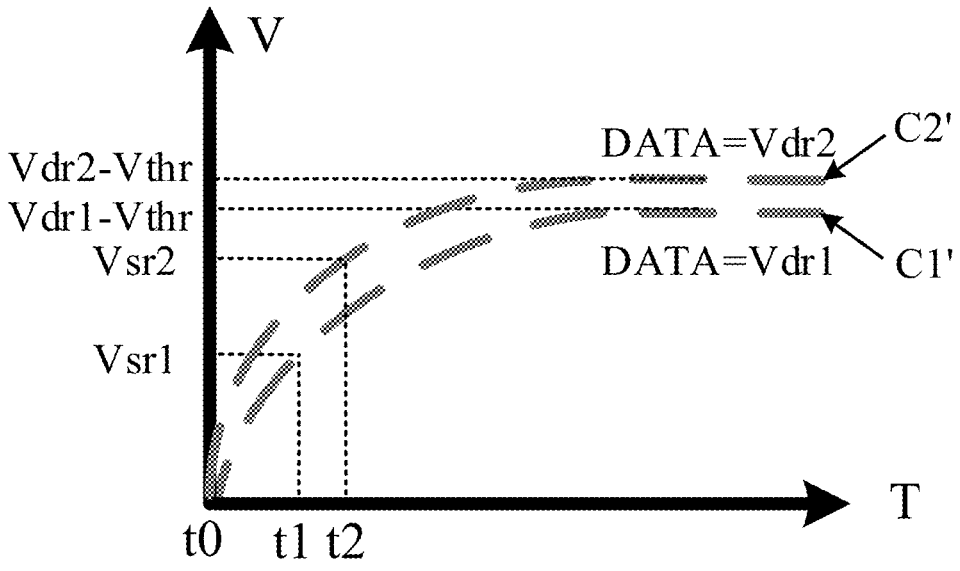
FIG. 2C shows sensing voltages versus time curves respectively in a first reference charging cycle and a second reference charging cycle, in a detecting method of a pixel circuit according to an embodiment of the present disclosure.

For example, as shown in FIG. 2C, the detecting method provided by the embodiment of the present disclosure further includes the following operations:

Step S210: in a first reference charging cycle, applying a first reference data voltage Vdr1 to the gate electrode of the driving transistor, and in the first time duration after applying the first reference data voltage Vdr1, obtaining the first reference sensing voltage Vsr1 at the first electrode of the driving transistor;

Step S220: in a second reference charging cycle, applying a second reference data voltage Vdr2 to the gate electrode of the driving transistor, and in the second time duration after applying the second reference data voltage Vdr2, obtaining the second reference sensing voltage Vsr2 at the first electrode of the driving transistor; and Step S230: obtaining the first reference data voltage Vdr1 according a third formula: $Vdr1=Kr*L1^{1/2}+Vthr$, and obtaining the second reference data voltage Vdr2 according a fourth formula: $Vdr2=Kr*L2^{1/2}+Vthr$.

Where Vdr1 represents the first reference data voltage, Vdr2 represents the second reference data voltage, Kr represents a reference current coefficient of the driving transistor, Vthr represents a reference threshold voltage of the driving transistor, L1 represents the first luminance value, and L2 represents the second luminance value.

For example, FIG. 2C shows a voltage versus time curve C1' of the first electrode of the driving transistor in the first reference charging cycle and a voltage versus time curve C2' of the first electrode of the driving transistor in the second reference charging cycle.

As shown in FIG. 2C, in step S210, for example, the first reference data voltage Vdr1 is applied to the gate electrode of the driving transistor at a start time t0 of the first reference charging cycle, and then in the first time duration (that is, t1−t0) after applying the first reference data voltage Vdr1, the first reference sensing voltage Vsr1 is obtained at the first electrode of the driving transistor.

As shown in FIG. 2C, in step S220, for example, the second reference data voltage Vdr2 is applied to the gate electrode of the driving transistor at a start time t0 of the second reference charging cycle, and then in second first time duration (that is, t2-t0) after applying the second reference data voltage Vdr2, the second reference sensing voltage Vsr2 is obtained at the first electrode of the driving transistor.

It should be noted that applying the first reference data voltage Vdr1 or the second reference data voltage Vdr2 to the gate electrode of the driving transistor means that the data voltage supplied through the data line of the pixel circuit is the first reference data voltage Vdr1 or the second reference data voltage Vdr2.

For example, the first reference charging cycle is prior to the first charging cycle. For example, the first reference charging cycle may be in a power-off state of a corresponding display device during a power-off process, and the first charging cycle may be during the first power-on period of the corresponding display device after the first reference charging cycle, that is, during a startup period or a normal display period after the corresponding display device is powered on; for example, the first reference charging cycle may also be in a power-on state when the corresponding display device is powered on, that is, during the startup period after the power-on to the normal display, the first charging cycle may be during the power-on period after the first reference charging period. For example, the first charging cycle may be between display periods of the normal display of the corresponding display device; the display periods each may be selected as various appropriate period, which is not specifically limited herein.

For the relationship between the second reference charging cycle and the second charging cycle, reference may be made to the relationship between the first reference charging cycle and the first charging cycle, and details are not described herein again.

Figure 3A:
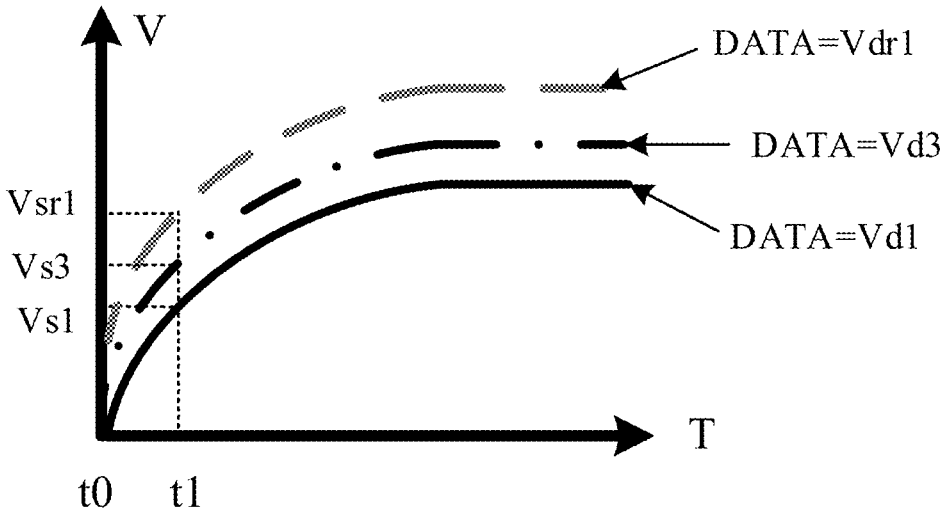
FIG. 3A is in a detecting method of a pixel circuit according to an embodiment of the present disclosure.

For example, as shown in FIG. 3A, in a case where the first sensing voltage Vs1 is not equal to the first reference sensing voltage Vsr1, the detecting method of the pixel circuit may further include the following operations:

Step S140: in a third charging cycle, applying a third data voltage Vd3 to the gate electrode of the driving transistor, and in the first time duration after applying the third data voltage Vd3, obtaining a third sensing voltage Vs3 at the first electrode of the driving transistor.

For example, FIG. 3A illustrates that, in a case where the first sensing voltage Vs1 is not equal to the first reference sensing voltage Vsr1 (for example, the first sensing voltage Vs1 is smaller than the first reference sensing voltage Vsr1), a voltage versus time curve of the first electrode of the driving transistor in the first reference charging cycle, a voltage versus time curve of the first electrode of the driving transistor in the first charging cycle, and a voltage versus time curve of the first electrode of the driving transistor in the third charging cycle.

For example, the third data voltage Vd3 is applied to the gate electrode of the driving transistor at a start time t0 of the third charging cycle, and then in the same first time duration (that is, t1−t0) after applying the third data voltage Vd3, the third sensing voltage Vs3 is obtained at the first electrode of the driving transistor. It should be noted that applying the third data voltage Vd3 to the gate electrode of the driving transistor means that the data voltage supplied through the data line of the pixel circuit is the third data voltage Vd3.

For example, as shown in FIG. 3A, a difference between the third sensing voltage Vs3 and the first reference sensing voltage Vsr1 may be made smaller than a difference between the first sensing voltage Vs1 and the first reference sensing voltage Vsr1 by selecting the third data voltage Vd3. It should be noted that the difference between the third sensing voltage Vs3 and the first reference sensing voltage Vsr1 refers to an absolute value |Vs3−Vsr1| of the difference between the third sensing voltage Vs3 and the first reference sensing voltage Vsr1; the difference between the first sensing voltage Vs1 and the first reference sensing voltage Vsr1 is an absolute value |Vs1−Vsr1| of the difference between the first sensing voltage Vs1 and the first reference sensing voltage Vsr1.

For example, the specific method of making the difference between the third sensing voltage Vs3 and the first reference sensing voltage Vsr1 smaller than the difference between the first sensing voltage Vs1 and the first reference sensing voltage Vsr1, by selecting the third data voltage Vd3, can be set according to actual conditions. The embodiments of the present disclosure do not limit this.

For example, the following method can be adopted to make the difference |Vs3−Vsr1| between the third sensing voltage Vs3 and the first reference sensing voltage Vsr1 to be smaller than the difference |Vs1−Vsr1| between the first sensing voltage Vs1 and the first reference sensing voltage Vsr1, that is, in a case where the first sensing voltage Vs1 is smaller than the first reference sensing voltage Vsr1, the third data voltage Vd3 is made larger than the first data voltage Vd1; and in a case where the first sensing voltage Vs1 is greater than the first reference sensing voltage Vsr1, the third data voltage Vd3 is made smaller than the first data voltage Vd1.

For example, as shown in FIG. 3A, for a same driving transistor, in view of the fact that a shape of a charging curve of the driving transistor during the detection process is substantially the same, in the case where the first sensing voltage Vs1 is smaller than the first reference sensing voltage Vsr1, and in a case where the present threshold voltage Vth is assumed to be constant, the sensing voltage can be increased by increasing the data voltage. Therefore, in the third charging cycle, the third sensing voltage Vs3 can be increased by making the third data voltage Vd3 larger than the first data voltage Vd1, so that the difference |Vs3−Vsr1| between the third sensing voltage Vs3 and the first reference sensing voltage Vsr1 can be smaller than the difference |Vs1−Vsr1| between the first sensing voltage Vs1 and the first reference sensing voltage Vsr1. Correspondingly, in the case where the first sensing voltage Vs1 is greater than the first reference sensing voltage Vsr1, the third data voltage Vd3 can be made smaller than the first data voltage Vd1, such that the difference |Vs3−Vsr1 between the third sensing voltage Vs3 and the first reference sensing voltages Vsr1 is smaller than the difference |Vs1−Vsr1| between the first sensing voltage Vs1 and the first reference sensing voltage Vsr1.

Figure 3B:
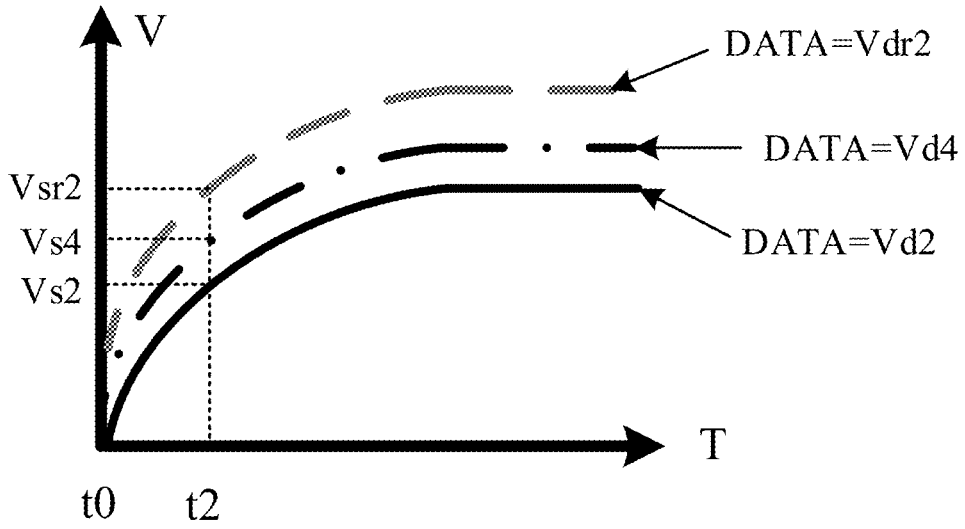
FIG. 3B shows sensing voltages versus time curves respectively in a second charging cycle, a fourth charging cycle and a second reference charging cycle, in a detecting method of a pixel circuit according to an embodiment of the present disclosure.

For example, as shown in FIG. 3B, in a case where the second sensing voltage Vs2 is not equal to the second reference sensing voltage Vsr2, the detecting method of the pixel circuit further includes the following operation:

Step S150: in a fourth charging cycle, applying a fourth data voltage Vd4 to the gate electrode of the driving transistor, and in the second time duration after applying the fourth data voltage Vd4, obtaining a fourth sensing voltage Vs4 at the first electrode of the driving transistor.

For example, FIG. 3B illustrates that, in the case where the second sensing voltage Vs2 is not equal to the second reference sensing voltage Vsr2 (for example, the second sensing voltage Vs2 is smaller than the second reference sensing voltage Vsr2), a voltage versus time curve of the first electrode of the driving transistor in the second reference charging cycle, a voltage versus time curve of the first electrode of the driving transistor in the second charging cycle, and a voltage versus time curve of the first electrode of the driving transistor in the fourth charging cycle.

For example, the fourth data voltage Vd4 is applied to the gate electrode of the driving transistor at a start time t0 of the fourth charging cycle, and then in the same second time duration (that is, t2-t0) after applying the fourth data voltage Vd4, the fourth sensing voltage Vs4 is obtained at the first electrode of the driving transistor. It should be noted that applying the fourth data voltage Vd4 to the gate electrode of the driving transistor means that the data voltage supplied through the data line of the pixel circuit is the fourth data voltage Vd4.

For example, as shown in FIG. 3B, a difference between the fourth sensing voltage Vs4 and the second reference sensing voltage Vsr2 may be made smaller than a difference between the second sensing voltage Vs2 and the second reference sensing voltage Vsr2 by selecting the fourth data voltage Vd4. It should be noted that the difference between the fourth sensing voltage Vs4 and the second reference sensing voltage Vsr2 refers to an absolute value |Vs4−Vsr2| of the difference between the fourth sensing voltage Vs4 and the second reference sensing voltage Vsr2; the difference between the second sensing voltage Vs2 and the second reference sensing voltage Vsr2 is an absolute value |Vs2−

Vsr2| of the difference between the second sensing voltage Vs2 and the second reference sensing voltage Vsr2.

For example, the specific method of making the difference between the fourth sensing voltage Vs4 and the second reference sensing voltage Vsr2 smaller than the difference between the second sensing voltage Vs2 and the second reference sensing voltage Vsr2, by selecting the fourth data voltage Vd4, can be set according to actual conditions. The embodiments of the present disclosure do not limit this.

For example, the following method can be adopted to make the difference |Vs4−Vsr2| between the fourth sensing voltage Vs4 and the second reference sensing voltage Vsr2 to be smaller than the difference |Vs2−Vsr2| between the second sensing voltage Vs2 and the second reference sensing voltage Vsr2, that is, in a case where the second sensing voltage Vs2 is smaller than the second reference sensing voltage Vsr2, the fourth data voltage Vd4 is made larger than the second data voltage Vd2; and in a case where the second sensing voltage Vs2 is greater than the second reference sensing voltage Vsr2, the fourth data voltage Vd4 is made smaller than the second data voltage Vd2.

For example, as shown in FIG. 3B, for a same driving transistor, in view of the fact that a shape of a charging curve of the driving transistor during the detection process is substantially the same, in the case where the second sensing voltage Vs2 is smaller than the second reference sensing voltage Vsr2, and in the case where the present threshold voltage Vth is assumed to be constant, the sensing voltage can be increased by increasing the data voltage. Therefore, in the fourth charging cycle, the fourth sensing voltage Vs4 can be increased by making the fourth data voltage Vd4 larger than the second data voltage Vd2, so that the difference |Vs4−Vsr2| between the fourth sensing voltage Vs4 and the second reference sensing voltage Vsr2 can be smaller than the difference |Vs2−Vsr2| between the second sensing voltage Vs2 and the second reference sensing voltage Vsr2. Correspondingly, in the case where the second sensing voltage Vs2 is greater than the second reference sensing voltage Vsr2, the fourth data voltage Vd4 can be made smaller than the second data voltage Vd2, such that the difference |Vs4−Vsr2| between the fourth sensing voltage Vs4 and the second reference sensing voltages Vsr2 is smaller than the difference |Vs2−Vsr2| between the second sensing voltage Vs2 and the second reference sensing voltage Vsr2.

For example, in the embodiments of the present disclosure, the first charging cycle and the third charging cycle may be between display periods in the power-on state. For example, the third charging cycle may be after the first charging cycle. For example, in a case where a duration of a time interval between two adjacent different frame images is less than a duration required to perform two charging cycles, the first charging cycle and the third charging cycle can be respectively performed in different time interval between two sets of different frame images. For example, in a case where the first charging cycle is between a period for displaying a third frame image and a period for displaying a fourth frame image, the third charging cycle may be in a time interval between a period for displaying an (n)th frame image and a period for displaying an (n+1)th frame image (n is an integer greater than 3). In this way, the time interval between different frame images can be fully utilized for detection.

For another example, in a case where the duration of the time interval between two adjacent different frame images is longer than the duration required to perform two charging cycles, the first charging cycle and the third charging cycle can be sequentially performed in the time interval between different frame images. For example, in a time interval between a period for displaying the third frame image and a period for displaying the fourth frame image, the first charging cycle and the third charging cycle are sequentially performed. In this way, the detection efficiency can be improved.

Likewise, the second charging cycle and the fourth charging cycle may be between the display periods in the power-on state. For example, the fourth charging cycle may be after the second charging cycle. For example, in the case where the duration of the time interval between two adjacent different frame images is less than the duration required to perform two charging cycles, the second charging cycle and the fourth charging cycle can be respectively performed in different time interval between two sets of different frame images. For example, in a case where the second charging cycle is between the period for displaying the fourth frame image and the period for displaying the fourth frame image, the fourth charging cycle may be in the time interval between the period for displaying the (n)th frame image and the period for displaying the (n+1)th frame image (n is an integer greater than 3), however the embodiments of the present disclosure are not limited thereto. In this way, the time interval between different frame images can be fully utilized for detection.

For another example, in the case where the duration of the time interval between two adjacent different frame images is longer than the duration required to perform two charging cycles, the second charging cycle and the fourth charging cycle can be sequentially performed in the time interval between different frame images. For example, in the time interval between the period for displaying the fourth frame image and the period for displaying the fourth frame image, the second charging cycle and the fourth charging cycle are sequentially performed. In this way, the detection efficiency can be improved.

For example, the detecting method provided by the embodiment of the present disclosure further includes the following operations:

Step S160: in a case where the third sensing voltage Vs3 is still not equal to the first reference sensing voltage Vsr1, repeating the third charging cycle until the third sensing voltage Vs3 is equal to the first reference sensing voltage Vsr1;

Step S170: in a case where the fourth sensing voltage Vs4 is still not equal to the second reference sensing voltage Vsr2, repeating the fourth charging cycle until the fourth sensing voltage Vs4 is equal to the second reference sensing voltage Vsr2; and Step S180: obtaining a present current coefficient of the driving transistor according to the third data voltage Vd3, the fourth data voltage Vd4 and a fifth formula: $K=(Vd3-Vd4)/(L1^{1/2}-L2^{1/2})$; and obtaining a present threshold voltage of the driving transistor according to a sixth formula: $Vth=(Vd4*L1^{1/2}-Vd3*L2^{1/2})/(L1^{1/2}-L2^{1/2})$.

Figure 4A:
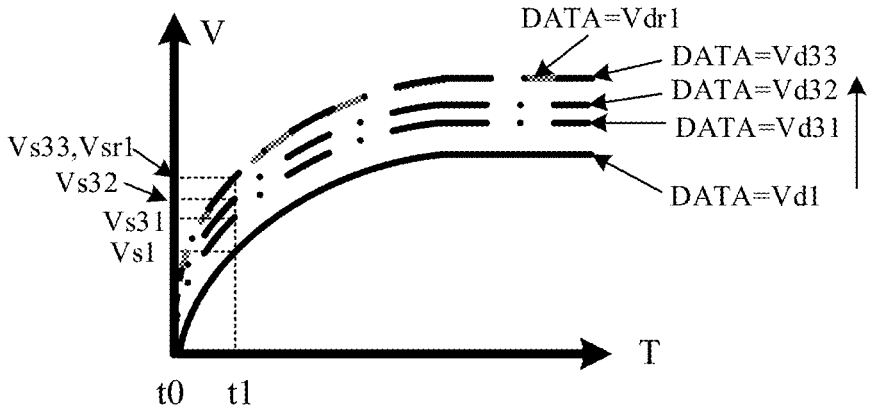
FIG. 4A shows sensing voltages versus time curves in a case where a third charging cycle is repeated many times, in a detecting method of a pixel circuit according to an embodiment of the present disclosure.

For example, in the step S160, as shown in FIG. 4A, the applied third data voltage Vd3 can be continuously adjusted by a successive approximation method until a sensing voltage equal to the first reference sensing voltage Vsr1 is finally obtained. For example, repeating the third charging cycle means applying the adjusted third data voltage Vd3 to the gate electrode of the driving transistor in the other third charging cycle (for example, from Vd31 to Vd32, from Vd32 to Vd33 . . . etc.), and in the first time duration after applying the third data voltage Vd3 and before the driving transistor is turned off, a new third sensing voltage Vs3 is obtained at the first electrode of the driving transistor (For example, in a case where the third data voltage Vd3 is Vd31, Vd32, and Vd33, respectively, the third sensing voltages Vs3 is Vs31, Vs32, and Vs33, respectively) to continuously reduce a difference |Vs3−Vsr1| between the third sensing voltage Vs3 and the first reference sensing voltage Vsr1 (For example, |Vs3−Vsr1| is reduced from |Vs31−Vsr1| to |Vs32−Vsr11, which is the successive approximation method) until the third sensing voltage Vs3 is equal to the first reference sensing voltage Vsr1 (for example, Vs33=Vsr1).

For example, in order to speed up the successive approximation, that is, to reduce the number of times of repeating the third charging cycle, the amount of change of the third data voltage Vd3 can be determined based on the difference |Vs3−Vsr1 between the third sensing voltage Vs3 and the first reference sensing voltage Vsr1. For example, ΔVd3=Vd32−Vd31 can be determined based on |Vs31−Vsr1|, and the adjusted third data voltage Vd3 (for example, Vd32) can be acquired.

Figure 4B:
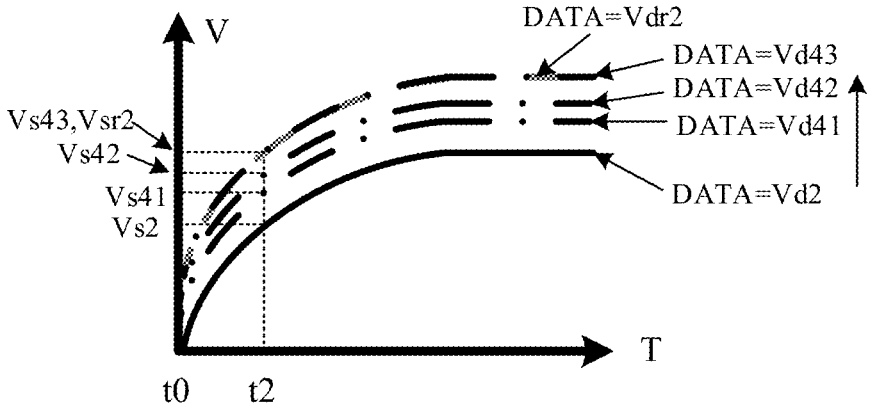
FIG. 4B shows sensing voltages versus time curves in a case where a fourth charging cycle is repeated many times, in a detecting method of a pixel circuit according to an embodiment of the present disclosure.

For example, in the step S170, as shown in FIG. 4B, the successive approximation method can also be used to continuously adjust the applied fourth data voltage Vd4 until finally obtaining a sensing voltage equal to the second reference sensing voltage Vsr2. For example, repeating the fourth charging cycle means applying the adjusted fourth data voltage Vd4 to the gate electrode of the driving transistor in the other fourth charging cycle (for example, from Vd41 to Vd42, from Vd42 to Vd43 . . . etc.), and in the first time duration after applying the fourth data voltage Vd4 and before the driving transistor is turned off, a new fourth sensing voltage Vs4 is obtained at the first electrode of the driving transistor (For example, in a case where the fourth data voltage Vd4 is Vd41, Vd42, and Vd43, respectively, the fourth sensing voltages Vs4 is Vs41, Vs42, and Vs43, respectively) to continuously reduce a difference |Vs4−Vsr2| between the fourth sensing voltage Vs4 and the second reference sensing voltage Vsr2 (For example, |Vs4−Vsr2| is reduced from |Vs41−Vsr2| to |Vs42−Vsr21, which is the successive approximation method) until the fourth sensing voltage Vs4 is equal to the second reference sensing voltage Vsr2 (for example, Vs43=Vsr2).

For example, the detecting method provided by the embodiment of the present disclosure further includes the following operation:

Step S310: obtaining the reference threshold voltage Vthr and the reference current coefficient Kr.

The method for obtaining the reference threshold voltage Vthr and the reference current coefficient Kr of the driving transistor can be set according to the actual situation, which is not limited by the embodiments of the present disclosure. The method for obtaining the reference threshold voltage Vthr and the reference current coefficient Kr will be exemplarily described below with reference to FIG. 5A to FIG. 5C.

Figure 5A:
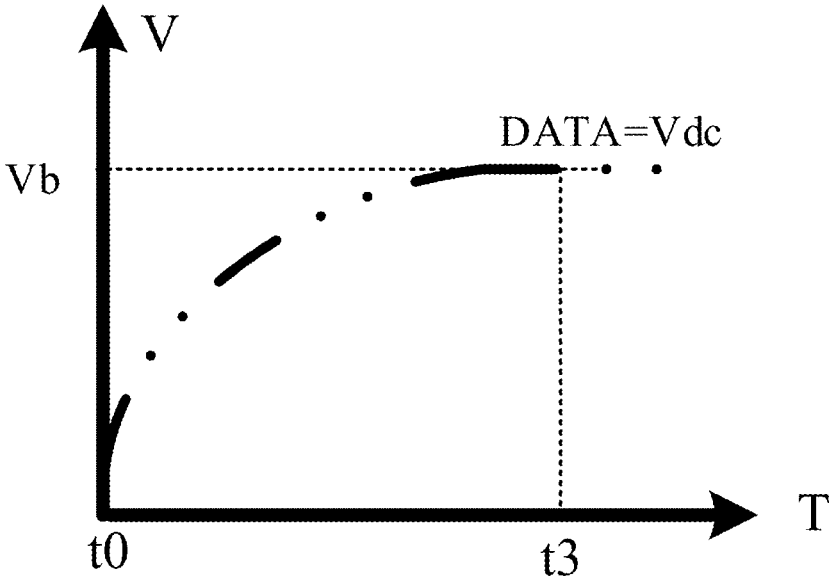
FIG. 5A is a curve of a sensing voltage versus time in a power-off charging cycle, in a detecting method of a pixel circuit according to an embodiment of the present disclosure.

For example, as shown in FIG. 5A, obtaining the reference threshold voltage Vthr includes the following operation:

Step S301: in a power-off charging cycle when the pixel circuit is in a power-off state, applying a power-off data voltage Vdc to the gate electrode of the driving transistor and after the driving transistor is turned off, obtaining a power-off sensing voltage Vb at the first electrode of the driving transistor; therefore, the reference threshold voltage Vthr of the driving transistor is equal to a difference between the power-off data voltage Vdc and the power-off sensing voltage Vb, that is, Vthr=Vdc−Vb.

For example, obtaining the reference current coefficient Kr includes the following operation:

Step S302: causing a normalized luminance value of the pixel circuit to reach a maximum value of 1, obtaining a data voltage Vmax applied to the gate electrode of the driving transistor at this time, and then obtaining the reference current coefficient Kr according to a seventh formula: Vmax=Kr+Vthr and the reference threshold voltage Vthr, that is, Kr=Vmax−Vthr.

For example, in some embodiments, the power-off charging cycle can be made to be different from the first reference charging cycle or the second reference charging cycle, whereby only the acquired reference threshold voltage Vthr may be saved. For example, the power-off data voltage Vdc may not be equal to the first reference data voltage Vdr1 or the second reference data voltage Vdr2.

Figure 5B:
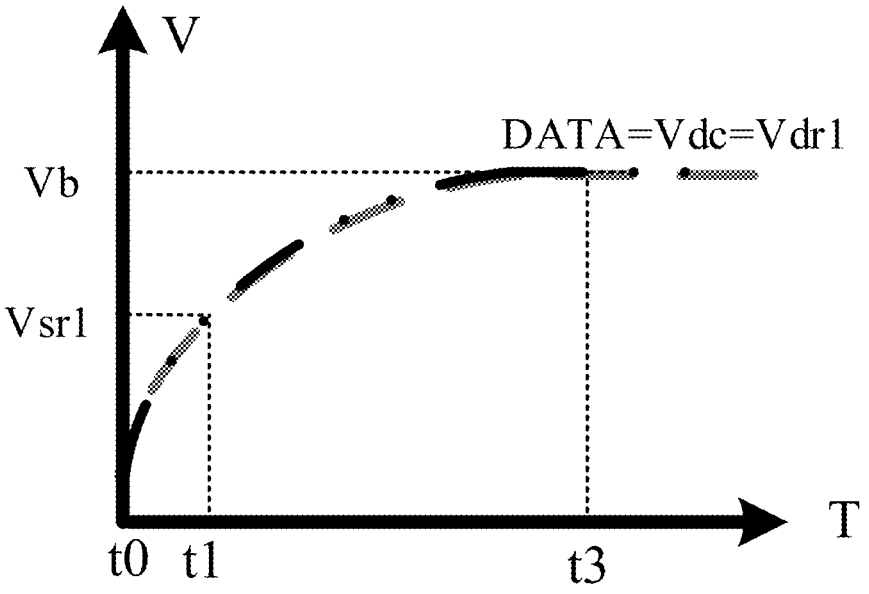
FIG. 5B is a curve of sensing voltage versus time in a case where a power-off charging cycle is the same as a first reference charging cycle, in a detecting method of a pixel circuit according to an embodiment of the present disclosure.

For example, as shown in FIG. 5B, in some embodiments, the power-off charging cycle may be the same as the first reference charging cycle, that is, the power-off charging cycle and the first reference charging cycle are the same charging cycle. In this case, the power-off data voltage Vdc and the first reference data voltage Vdr1 can be equal, whereby the detecting method of the pixel circuit can be simplified.

Figure 5C:
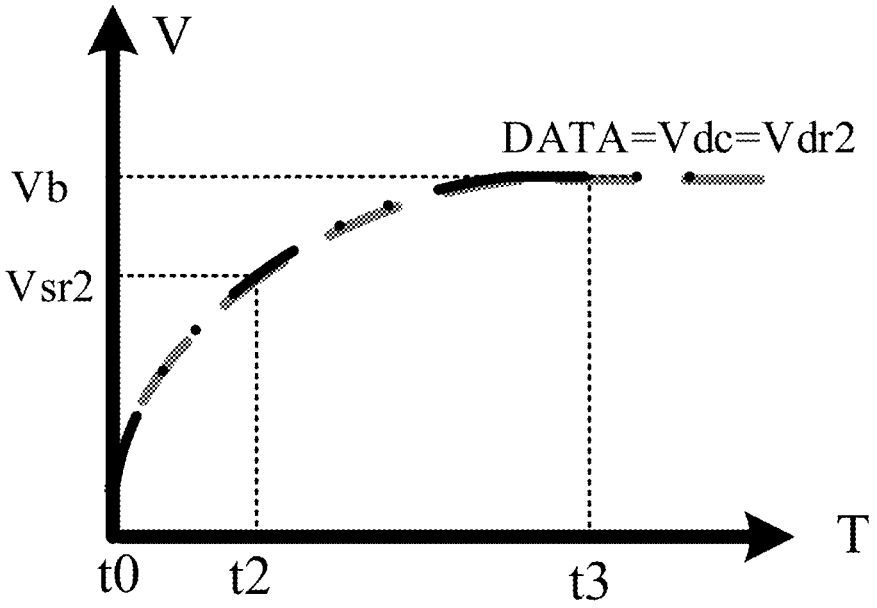
FIG. 5C is a curve of sensing voltage versus time in a case where a power-off charging cycle is the same as a second reference charging cycle, in a detecting method of a pixel circuit according to an embodiment of the present disclosure.

For another example, as shown in FIG. 5C, in some embodiments, the power-off charging cycle may be the same as the second reference charging cycle, that is, the power-off charging cycle and the second reference charging cycle are the same charging cycle. In this case, the power-off data voltage Vdc and the second reference data voltage Vdr2 can be equal, whereby the detecting method of the pixel circuit can be simplified.

In the embodiments of the present disclosure, by comparing the first reference sensing voltage Vsr1 with the first sensing voltage Vs1 obtained at the first time duration after applying the first data voltage Vd1, and comparing the second reference sensing voltage Vsr2 with the second sensing voltage Vs2 obtained at the second time duration after applying the second data voltage Vd2, the present threshold voltage Vth of the pixel circuit is acquired while the present current coefficient K of the pixel circuit can be obtained, thereby completing the compensation detection of the pixel circuit, and the compensation effect and the brightness uniformity of the display panel, which is using the detecting method of the pixel circuit, can be improved.

The detecting method of the pixel circuit provided by the embodiment of the present disclosure can be used to detect the threshold voltage and current coefficient of the driving transistor T3 (N-type transistor) in the pixel circuit as shown in FIG. 6A, but embodiments of the present disclosure are not limited thereto. For example, the detecting method of the pixel circuit provided by the embodiment of the present disclosure can also be used to detect the threshold voltage and current coefficient of the driving transistor T3 (P-type transistor) in the pixel circuit as shown in FIG. 6B. For example, for the sake of clarity, the specific structure of the pixel circuit will be specifically described below by taking the pixel circuit as shown in FIG. 6A as an example, but the embodiments of the present disclosure do not limit this.

For example, as shown in FIG. 6A, the pixel circuit includes a driving transistor T3. For example, as shown in FIG. 6A, the pixel circuit may further include a light emitting element EL and a sensing switch transistor T2. For example, the light emitting element EL may be an organic light emitting diode, but the embodiments of the present disclosure are not limited thereto, and may be, for example, a quantum dot light emitting diode (QLED) or the like. For example, a second electrode of the driving transistor T3 is configured to be connected with a first power supply voltage terminal VDD, for receiving a first voltage supplied by the first power supply voltage terminal VDD, and the first voltage may be, for example, a constant positive voltage; a first electrode of the driving transistor T3 is configured to be connected with a first electrode of the light emitting element EL. A second electrode of the light emitting element EL is connected with a second power supply voltage terminal VSS, the second power supply voltage terminal VSS can provide a constant voltage, for example, the voltage supplied by the second power supply voltage terminal VSS can be, for example, smaller than the voltage supplied by the first power supply voltage terminal VDD. The second power supply voltage terminal VSS can be grounded, for example, but the embodiments of the present disclosure do not limit this.

For example, as shown in FIG. 6A, a first electrode (a source electrode) of the sensing switch transistor T2 is electrically connected with the first electrode of the driving transistor T3. For example, as shown in FIG. 6A, the pixel circuit further includes a sensing line SEN, a second electrode of the sensing switch transistor T2 is electrically connected with the sensing line SEN, and the sensing line SEN is electrically connected with, for example, a detecting circuit (not shown in FIG. 6A). For example, as shown in FIG. 6A, the pixel circuit further includes a data writing transistor T1 and a storage capacitor Cst, the data writing transistor T1 is configured to write a data signal to the gate electrode of the driving transistor T3 (for example, the first data voltage, the second data voltage, the first reference data voltage, and the second reference data voltage, etc.), and the storage capacitor Cst is configured to store the data signal. For example, the pixel circuit further includes a data line Vdat, and a first electrode of the data writing transistor T1 is electrically connected with the data line Vdat.

At least an embodiment of the present disclosure further provides a driving method of a display panel. For example, the display panel includes a plurality of pixel circuits, and the pixel circuits included in the display panel are arranged, for example, in an array. For example, each of the pixel circuits included in the display panel may be the pixel circuit as shown in FIG. 6A or 6B. For example, as shown in FIG. 7, the driving method includes the following operation:

Step S410: performing the detecting method of the pixel circuit provided by any one of the embodiments of the present disclosure on the pixel circuit for obtaining a present threshold voltage Vth and a present current coefficient K of the driving transistor T3 of the pixel circuit.

For example, the detecting method of the pixel circuit can be referred to the corresponding description in the above embodiment, and details are not described herein again.

Figure 7:
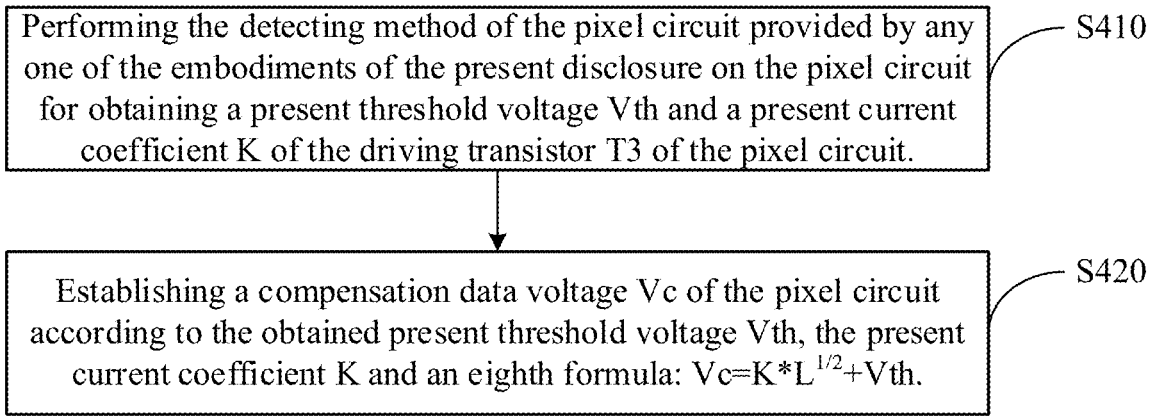
FIG. 7 is a schematic flowchart of a driving method of a display panel provided by an embodiment of the present disclosure.

For example, as shown in FIG. 7, the driving method of the display panel provided by the embodiment of the present disclosure further includes the following operation:

Step S420: establishing a compensation data voltage Vc of the pixel circuit according to the obtained present threshold voltage Vth, the present current coefficient K and an eighth formula: $Vc=K*L^{1/2}+Vth$.

In the eighth formula, Vc represents the compensation data voltage, K represents the present current coefficient, Vth represents the present threshold voltage, and L represents a normalized luminance value to be displayed by the pixel circuit.

For example, in an example, first, the present threshold voltage and the present current coefficient of the driving transistor T3 of the pixel circuit can be detected row by row, and then, after obtaining the present threshold voltages and the present current coefficients of the driving transistors T3 of all the pixel circuits of the display panel, the compensation data voltage can be established for each pixel circuit, and finally, based on the established compensation data voltage, data compensation is performed on the display panel, thereby completing one cycle of data compensation.

For example, the detecting method of the pixel circuit provided by any one of the embodiments of the present disclosure can be performed on pixel circuits located in the first row, and the present threshold voltages and the present current coefficients of the driving transistors T3 of the pixel circuits located in the first row are obtained; then, the detecting method of the pixel circuit provided by any one of the embodiments of the present disclosure can be performed on the pixel circuits located in the second row, and the present threshold voltages and the present current coefficients of the driving transistors T3 of the pixel circuits located in the second row are obtained; and then, the pixel circuits of the display panel located in other rows are performed by line-by-line detection until the present threshold voltages and present current coefficients of the driving transistors T3 of all the pixel circuits of the display panel are obtained; finally, the compensation data voltage is established for each pixel circuit, and data compensation is performed on the display panel.

For example, in another example, after detecting the present threshold voltages and the present current coefficients of the driving transistors T3 of a row of pixel circuits, a compensation data voltage is established for each pixel circuit of the row, and then data compensation is performed on the pixel circuits located in the row. For example, detecting, establishing compensation data voltages and data compensating are performed on the pixel circuits of the first row; and then, the detecting, establishing compensation data voltages and data compensating are performed on the pixel circuits of a fifth row; and then, the detecting, establishing compensation data voltages and data compensating are performed on the pixel circuits of the second row until the detecting, establishing compensation data voltages and data compensating are performed on all the pixel circuits of the display panel, thereby realizing one cycle of data compensation for the display panel.

It should be noted that other indispensable steps of the driving method of the display panel can be referred to a driving method of a conventional display panel, which are understood by those skilled in the art, and are not described herein.

For example, the driving method of the display panel provided by the embodiment of the present disclosure can implement detection of the present threshold voltage and the present current coefficient of the driving transistor T3 during a power-on period (for example, between adjacent display cycles), thereby realizing a real-time compensation, and can further improve the compensation effect and the brightness uniformity of the display panel to which the driving method is applied.

At least one embodiment of the present disclosure further provides a display device including a pixel circuit and a control circuit. The pixel circuit may be the pixel circuit as shown in FIG. 6A or 6B. For example, the display device provided by the embodiment of the present disclosure is specifically described below by taking the pixel circuit as shown in FIG. 6A as an example, but the embodiments of the present disclosure are not limited thereto.

Figure 8:
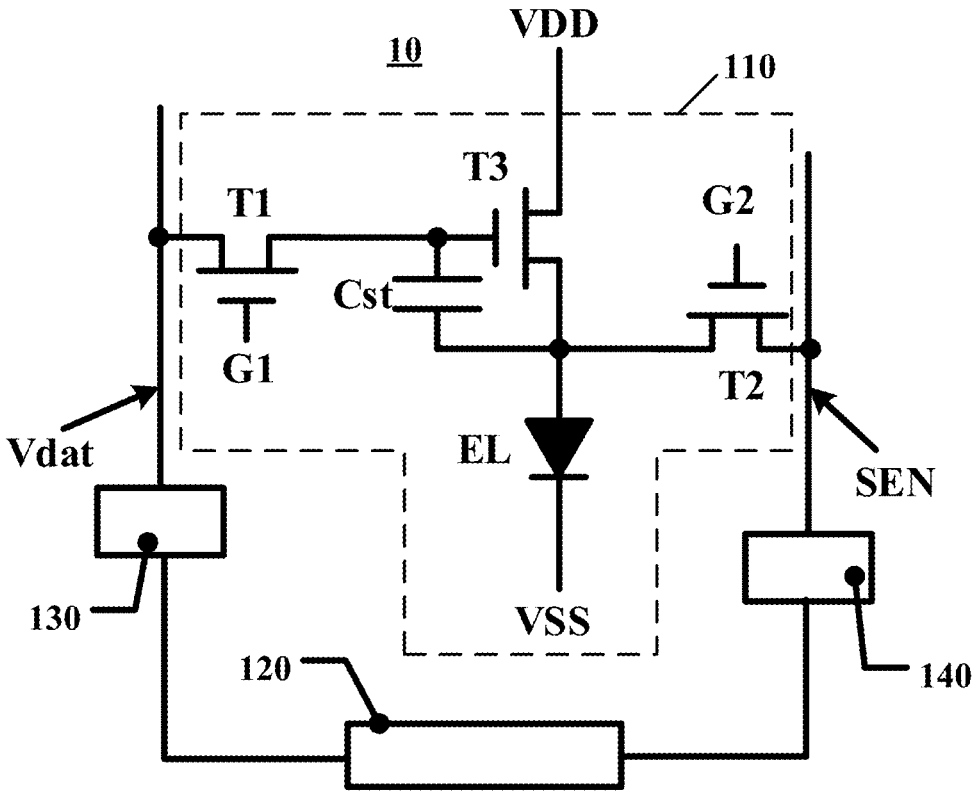
FIG. 8 is an exemplary structural diagram of a display device provided by an embodiment of the present disclosure.

For example, FIG. 8 shows a schematic diagram of a display device 10. For example, as shown in FIG. 8, the display device 10 includes a pixel circuit 110 and a control circuit 120, and the pixel circuit 110 includes a driving transistor T3. For example, the control circuit 120 is configured to perform the detecting method of the pixel circuit provided by the embodiment of the present disclosure, that is, the control circuit 120 can be configured to perform or partially perform steps S110, S120, S130, S140, S150, S160, S170, S180, S210, S220, S230, S310, S301, S302, and the like in the above embodiment.

For example, as shown in FIG. 8, the display device 10 further includes a data driving circuit 130, a detecting circuit 140 and a scan driving circuit (not shown in FIG. 8). For example, the control circuit 120 can further be configured to control the data driving circuit 130 and the detecting circuit 140.

For example, the data driving circuit 130 is configured to output the first reference data voltage, the second reference data voltage, the first data voltage, the second data voltage, the third data voltage, and the fourth data voltage, etc., at different times. The scan driving circuit outputs the scanning signal for the data writing transistor T1 and the sensing transistor T2. For example, the scan driving circuit can be connected with the gate electrode G1 of the data writing transistor T1 and the gate electrode G2 of the sensing transistor T2 to provide a corresponding scanning signal, thereby controlling the turn-on and turn-off of the data writing transistor T1 and the sensing transistor T2.

For example, the pixel circuit is further configured to receive the first reference data voltage, the second reference data voltage, the first data voltage, the second data voltage, the third data voltage, and the fourth data voltage, etc., and apply one of the first reference data voltage, the second reference data voltage, the first data voltage, the second data voltage, the third data voltage and the fourth data voltage to the gate electrode of the driving transistor T3. For example, the detecting circuit 140 is configured to read the first reference sensing voltage, the second reference sensing voltage, the first sensing voltage, the second sensing voltage, the third sensing voltage, and the fourth sensing voltage, etc. from the first electrode of the driving transistor T3.

For example, the data driving circuit 130 can be further configured to provide the power-off data voltage, the pixel circuit can be further configured to receive the power-off data voltage and apply the power-off data voltage to the gate electrode of the driving transistor T3, and the detecting circuit 140 can further be configured to read a turn-off sensing voltage from the first electrode of the driving transistor T3.

For example, the pixel circuit further includes a light emitting element EL and a sensing switch transistor T2, and the light emitting element EL may be, for example, an organic light emitting diode, but the embodiments of the present disclosure are not limited thereto, and may be, for example, a quantum dot light emitting diode (QLED) or the like. For example, the second electrode of the driving transistor T3 and the first electrode of the driving transistor T3 are configured to be connected with the first power supply voltage terminal VDD and a first electrode of the light emitting element EL, respectively, and a second electrode of the light emitting element EL is connected with the second power supply voltage terminal VSS. For example, a first electrode of the sensing switch transistor T2 is electrically connected with the first electrode of the driving transistor T3, and a second electrode of the sensing switch transistor T2 is electrically connected with the detecting circuit 140.

For example, the pixel circuit further includes a sensing line SEN, and the sensing line SEN electrically connects the second electrode of the sensing switch transistor T2 with the detecting circuit 140.

For example, the pixel circuit further includes a data writing transistor T1 and a storage capacitor Cst, the data writing transistor T1 is configured to obtain a data voltage from the data driving circuit 130 and write the data voltage to the gate electrode of the driving transistor T3, and the storage capacitor Cst stores the data voltage. For example, the pixel circuit further includes a data line Vdat, and the first electrode of the data writing transistor T1 is connected with the data line Vdat.

Figure 9:
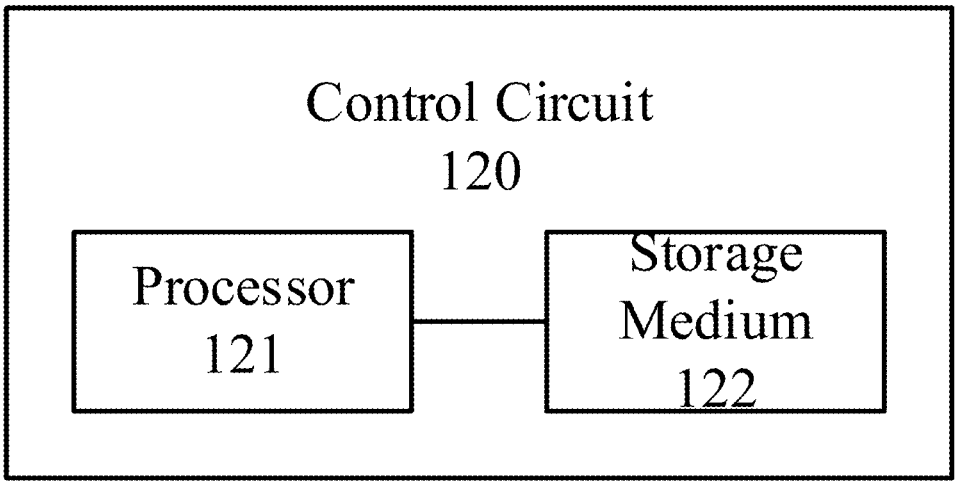
FIG. 9 is a schematic diagram of a control circuit in a display device provided by an embodiment of the present disclosure.

For example, as shown in FIG. 9, the control circuit 120 includes a processor 121 and a storage medium 122, the storage medium 122 is configured to store computer instructions executable by the processor 121, and the computer instructions are capable of being executed by the processor 121 to implement the detecting method provided by the embodiments of the present disclosure.

For example, the processor 121 is, for example, a central processing unit (CPU) or other processing units with a data processing ability and/or instruction execution ability. For example, the processor may be implemented as a general processor, or may also be implemented as a single chip microcomputer, a microprocessor, a digital signal processor, a dedicated image processing chip, a field programmable logic array, or the like.

For example, the storage medium 122 includes a volatile memory and/or a nonvolatile memory, and for example, includes a read only memory (ROM), a hard disk, a flash memory, or the like. Accordingly, the storage medium may be implemented as one or a plurality of computer program products, which may include various forms of computer-readable storage medium, and one or a plurality of executable codes (for example, computer program instructions) can be stored in the computer-readable storage medium. The processor can execute the program instructions to perform the detecting method provided by the embodiment of the present disclosure, thereby obtaining the present threshold voltage and the present current coefficient of the driving transistor of the pixel circuit included in the display device, thereby implementing the data compensation function of the display device. For example, the storage medium may further store various other applications and various data, such as the reference threshold voltage and/or the reference current coefficient of each pixel circuit, as well as various data used and/or generated by the applications, or the like.

For example, the display device provided by the embodiment of the present disclosure can implement detection of the present threshold voltage and the present current coefficient of the driving transistor during a power-on period (for example, between adjacent display cycles), thereby realizing a real-time detection and a real-time compensation during the power-on period of the display device, and can further improve the compensation effect and the brightness uniformity of the display device.

What have been described above are only specific implementations of the present disclosure, the protection scope of the present disclosure is not limited thereto. The protection scope of the present disclosure should be based on the protection scope of the claims.

What is claimed is:

1. A detecting method of a pixel circuit, wherein the pixel circuit comprises a driving transistor, and the detecting method comprises:

in a first charging cycle, applying a first data voltage to a gate electrode of the driving transistor, and in a first time duration after applying the first data voltage and before the driving transistor is turned off, obtaining a first sensing voltage at a first electrode of the driving transistor and determining whether the first sensing voltage is equal to a first reference sensing voltage; and in a second charging cycle, applying a second data voltage to the gate electrode of the driving transistor, and in a second time duration after applying the second data voltage and before the driving transistor is turned off, obtaining a second sensing voltage at the first electrode of the driving transistor and determining whether the second sensing voltage is equal to a second reference sensing voltage;

wherein if the first sensing voltage is equal to the first reference sensing voltage and the second sensing voltage is equal to the second reference sensing voltage, obtaining a present current coefficient of the driving transistor according to the first data voltage, the second data voltage and a first formula: $K=(Vd1-Vd2)/(L1^{1/2}-L2^{1/2})$; and obtaining a present threshold voltage of the driving transistor according to a second formula: $Vth=(Vd2*L1^{1/2}-Vd1*L2^{1/2})/(L1^{1/2}-L2^{1/2})$;

wherein K represents the present current coefficient of the driving transistor, Vth represents the present threshold voltage of the driving transistor, Vd1 represents the first data voltage, Vd2 represents the second data voltage, L1 represents a first luminance value, L2 represents a second luminance value, and the first luminance value and the second luminance value are both specified normalized luminance values.

2. The detecting method according to claim 1, further comprising:

in a first reference charging cycle, applying a first reference data voltage to the gate electrode of the driving transistor, and in the first time duration after applying the first reference data voltage, obtaining the first reference sensing voltage at the first electrode of the driving transistor; and in a second reference charging cycle, applying a second reference data voltage to the gate electrode of the driving transistor, and in the second time duration after applying the second reference data voltage, obtaining the second reference sensing voltage at the first electrode of the driving transistor;

wherein obtaining the first reference data voltage according a third formula: $Vdr1=Kr*L1^{1/2}+Vthr$, and obtaining the second reference data voltage according a fourth formula: $Vdr2=Kr*L2^{1/2}+Vthr$;

wherein Vdr1 represents the first reference data voltage, Vdr2 represents the second reference data voltage, Kr represents a reference current coefficient of the driving transistor, and Vthr represents a reference threshold voltage of the driving transistor.

3. The detecting method according to claim 2, further comprising obtaining the reference threshold voltage and the reference current coefficient, wherein obtaining the reference threshold voltage comprises:

in a power-off charging cycle when the pixel circuit is in a power-off state, applying a power-off data voltage to the gate electrode of the driving transistor and after the driving transistor is turned off, obtaining a power-off sensing voltage at the first electrode of the driving transistor; wherein the reference threshold voltage of the driving transistor is equal to a difference between the power-off data voltage and the power-off sensing voltage; and obtaining the reference current coefficient comprises:

causing a normalized luminance value of the pixel circuit to reach a maximum value of 1, obtaining a data voltage Vmax applied to the gate electrode of the driving transistor at this time, and then obtaining the reference current coefficient according to a seventh formula:

$Vmax=Kr+Vthr$.

4. The detecting method according to claim 3, wherein the power-off charging cycle is the same as the first reference charging cycle, and the power-off data voltage is equal to the first reference data voltage; or the power-off charging cycle is the same as the second reference charging cycle, and the power-off data voltage is equal to the second reference data voltage.

5. The detecting method according to claim 1, further comprising:

in a case where the first sensing voltage is not equal to the first reference sensing voltage, in a third charging cycle, applying a third data voltage to the gate electrode of the driving transistor, and in the first time duration after applying the third data voltage, obtaining a third sensing voltage at the first electrode of the driving transistor; and wherein selecting the third data voltage such that a difference between the third sensing voltage and the first reference sensing voltage is less than a difference between the first sensing voltage and the first reference sensing voltage.

6. The detecting method according to claim 5, further comprising:

in a case where the second sensing voltage is not equal to the second reference sensing voltage, in a fourth charging cycle, applying a fourth data voltage to the gate electrode of the driving transistor, and in the second time duration after applying the fourth data voltage, obtaining a fourth sensing voltage at the first electrode of the driving transistor; and wherein selecting the fourth data voltage such that a difference between the fourth sensing voltage and the second reference sensing voltage is less than a difference between the second sensing voltage and the first reference sensing voltage.

7. The detecting method according to claim 6, wherein in a case where the second sensing voltage is less than the second reference sensing voltage, causing the fourth data voltage to be greater than the second data voltage; and in a case where the second sensing voltage is greater than the second reference sensing voltage, causing the fourth data voltage to be less than the second data voltage.

8. The detecting method according to claim 6, further comprising:

in a case where the third sensing voltage is still not equal to the first reference sensing voltage, repeating the third charging cycle until the third sensing voltage is equal to the first reference sensing voltage;

in a case where the fourth sensing voltage is still not equal to the second reference sensing voltage, repeating the fourth charging cycle until the fourth sensing voltage is equal to the second reference sensing voltage; and obtaining a present current coefficient of the driving transistor according to the third data voltage, the fourth data voltage and a fifth formula: $K=(Vd3-Vd4)/(L1^{1/}$ $_2-L2^{1/2}$); and obtaining a present threshold voltage of the driving transistor according to a sixth formula: $Vth=(Vd4*L1^{1/2}-Vd3*L2^{1/2})/(L1^{1/2}-L2^{1/2})$;

wherein Vd3 represents the third data voltage, and Vd4 represents the fourth data voltage.

9. The detecting method according to claim 6, wherein the first charging cycle, the second charging cycle, the third charging cycle, and the fourth charging cycle are between display cycles.

10. The detecting method according to claim 5, wherein in a case where the first sensing voltage is less than the first reference sensing voltage, causing the third data voltage to be greater than the first data voltage; and in a case where the first sensing voltage is greater than the first reference sensing voltage, causing the third data voltage to be less than the first data voltage.

11. The detecting method according to claim 1, wherein the first time duration is the same as the second time duration.

12. A driving method of a display panel, wherein the display panel comprises a pixel circuit, and the driving method comprises:

performing the detecting method according to claim 1 on the pixel circuit, so as to obtain a present threshold voltage of a driving transistor of the pixel circuit and a present current coefficient of the driving transistor of the pixel circuit.

13. The driving method according to claim 12, further comprising:

establishing a compensation data voltage of the pixel circuit according to the present threshold voltage, the present current coefficient and an eighth formula: $Vc=K*L^{1/2}+Vth$;

wherein Vc represents the compensation data voltage, K represents the present current coefficient, Vth represents the present threshold voltage, and L represents a normalized luminance value to be displayed by the pixel circuit.

14. A display device, comprising a pixel circuit and a control circuit, wherein the pixel circuit comprises a driving transistor, and the control circuit is configured to perform the detecting method according to claim 1.

15. The display device according to claim 14, wherein the control circuit is further configured to perform:

in a first reference charging cycle, applying a first reference data voltage to the gate electrode of the driving transistor, and in the first time duration after applying the first reference data voltage, obtaining the first reference sensing voltage at the first electrode of the driving transistor; and in a second reference charging cycle, applying a second reference data voltage to the gate electrode of the driving transistor, and in the second time duration after applying the second reference data voltage, obtaining the second reference sensing voltage at the first electrode of the driving transistor;

wherein obtaining the first reference data voltage according a third formula: $Vdr1=Kr*L1^{1/2}+Vthr$, and obtaining the second reference data voltage according a fourth formula: $Vdr2=Kr*L2^{1/2}+Vthr$;

wherein Vdr1 represents the first reference data voltage, Vdr2 represents the second reference data voltage, Kr represents a reference current coefficient of the driving transistor, and Vthr represents a reference threshold voltage of the driving transistor.

16. The display device according to claim 14, wherein the control circuit comprises a processor and a storage medium, the storage medium is configured to store computer instructions executable by the processor, and the computer instructions are capable of being executed by the processor to implement the detecting method.

17. The display device according to claim 15, further comprising a data driving circuit and a detecting circuit, wherein the data driving circuit is configured to output the first reference data voltage, the second reference data voltage, the first data voltage and the second data voltage;

the pixel circuit is further configured to receive the first reference data voltage, the second reference data voltage, the first data voltage and the second data voltage, and apply one of the first reference data voltage, the second reference data voltage, the first data voltage and the second data voltage to the gate electrode of the driving transistor;

the detecting circuit is configured to read the first reference sensing voltage, the second reference sensing voltage, the first sensing voltage and the second sensing voltage from the first electrode of the driving transistor; and the control circuit is further configured to control the data driving circuit and the detecting circuit.

18. The display device according to claim 17, wherein the pixel circuit further comprises a light emitting element and a sensing switch transistor, a second electrode and the first electrode of the driving transistor are configured to be respectively connected with a first power voltage terminal and a first electrode of the light emitting element, a second electrode of the light emitting element is connected with a second power voltage terminal, a first electrode of the sensing switch transistor is electrically connected with the first electrode of the driving transistor, and a second electrode of the sensing switch transistor is electrically connected with the detecting circuit.

19. The display device according to claim 18, wherein the pixel circuit further comprises a sensing line, and the sensing line electrically connects the second electrode of the sensing switch transistor with the detecting circuit.

20. The display device according to claim 19, wherein the pixel circuit further comprises a data writing transistor and a storage capacitor, the data writing transistor is configured to obtain a data voltage from the data driving circuit and write the data voltage to the gate electrode of the driving transistor, and the storage capacitor stores the data voltage.

* * * * *